US005383292A

United States Patent [19]

Whittredge

[11] Patent Number: 5,383,292

[45] Date of Patent: Jan. 24, 1995

[54] ALTERNATING MOTION DEVICE FOR ANIMATING GRAPHICAL STRUCTURES

[76] Inventor: David A. Whittredge, 7 Aberdeen Rd., Arlington, Mass. 02174

[21] Appl. No.: 13,040

[22] Filed: Feb. 3, 1993

[51] Int. Cl.[6] ..... G09F 1/08

[52] U.S. Cl. ..... 40/124.1; 40/445; 446/151

[58] Field of Search ..... 446/151, 152; 229/92.8; 40/539, 124.1, 445, 417, 421

[56] References Cited

U.S. PATENT DOCUMENTS

| | | | |
|---|---|---|---|
| 1,988,045 | 1/1935 | Morris | 40/445 |
| 2,384,662 | 9/1945 | Wehr | 446/152 |
| 2,432,318 | 12/1947 | Leech | 446/151 |
| 2,500,106 | 3/1950 | Wehr | 40/421 |
| 2,884,724 | 5/1959 | Lohnes et al. | 446/151 |
| 2,895,244 | 7/1959 | Youngren | 446/151 |
| 3,318,040 | 5/1967 | Kinberg | 446/151 |
| 3,486,270 | 12/1969 | Maher | 446/152 |
| 3,559,321 | 2/1971 | Helms | 40/421 |

*Primary Examiner*—Peter R. Brown
*Assistant Examiner*—Joanne Silbermann

[57] ABSTRACT

This is a device for animating pop-up graphical structures as are sometimes found in graphic media. The device changes the back and forth relative motion of elements in the device into alternating movement to animate elements like wings, arms, and eyes in graphical constructs. In operation, a movable element (38) in the device follows a zig-zag track (52) in another element of the device resulting in alternating movement in the attached graphical element (56).

13 Claims, 24 Drawing Sheets

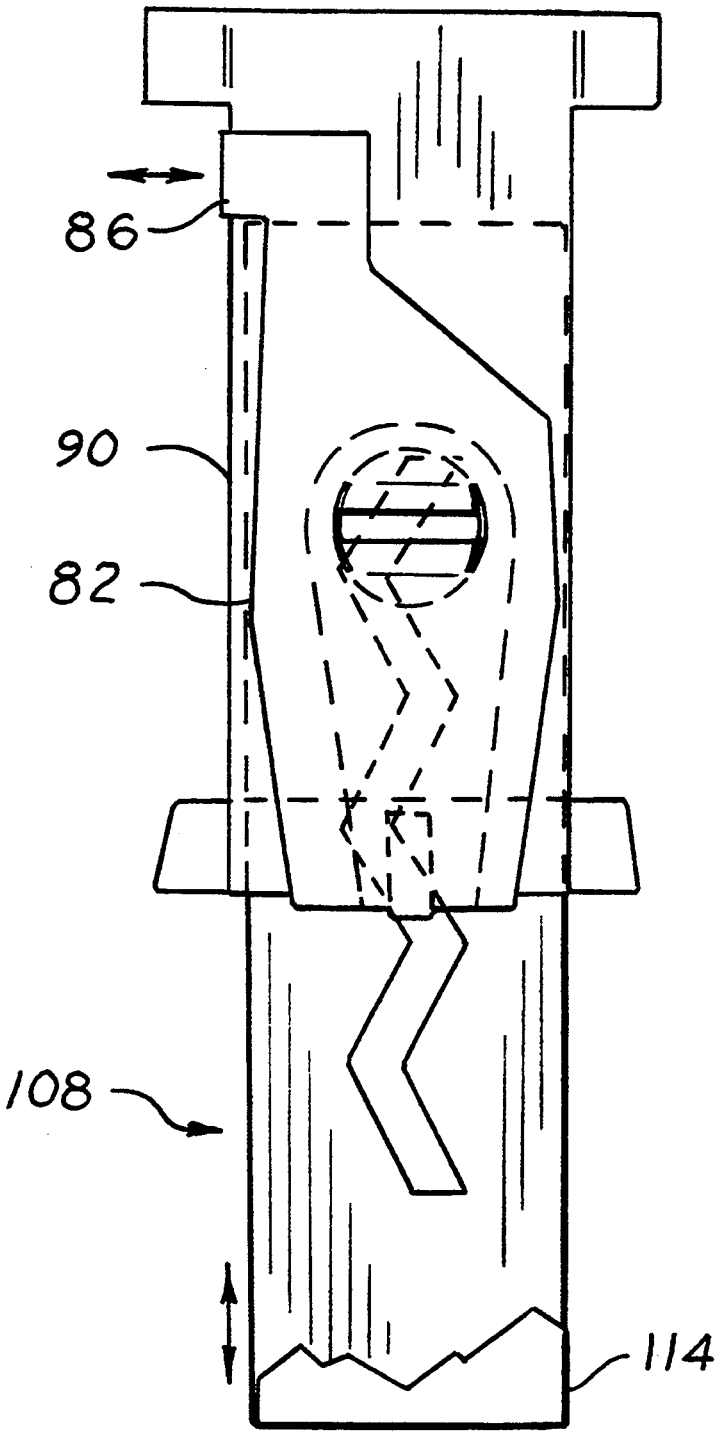
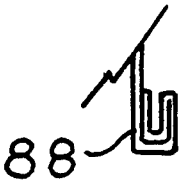
Fig. 16
Fig. 17

ALTERNATING MOTION DEVICE FOR ANIMATING GRAPHICAL STRUCTURES

BACKGROUND OF THE INVENTION

1. Field of the Invention

The invention relates in general to pop-up type graphics mechanisms and in particular to graphics-animating mechanisms that produce alternating action in structures attached to them.

2. Description of Prior Art

The prior art is in the form of pop-up type structures and slide-activated type "paper engineering" commonly seen in children's pop-up books, novelty greeting cards, and in advertising products. The pop-up devices used in the prior art are typically folded structures that are activated by the opening of a card or turning of a page that causes a pop up, or rapid unfolding of the structures into three-dimensional forms. Other related devices are of the sliding type in which structures are activated by linear pushing and pulling of paper tabs which cause structures to raise up and down, move left and right, flop over from front to back or in otherwise similar ways. Graphical structures of this type are published within copyrighted material and are not normally patented. Two excellent examples of this prior art are found in the pop-up books *Jungle Bugs*, by David Carter, published by Simon & Schuster, N.Y., N.Y. Copyright 1992, and *Who's Peeking at Me?*, by Kees Moerbeek, published by Price, Stern, Sloan, L.A., Calif. Copyright 1988. Both books exhibit high levels of innovation in activating graphical structures.

Examples of related prior art that have been patented are found in the animation device of Charles Robert Helms, U.S. Pat. No. 3,559,321 (pat. Feb. 2, 1971) and in the animated greeting card of Edith M. Maher, U.S. Pat. No. 3,486,270 (pat. Dec. 30, 1969). The Helms U.S. Pat. No. 3,559,321 discloses a number of embodiments that use hinged members within folded covers to transfer sliding movement of paper elements in unobvious directions. The Maher U.S. Pat. No. 3,486,270 uses string means to operate puppet figures that are movably attached to a card structure.

SUMMARY OF THE INVENTION

The invention relates to devices designed for use in graphic arts media for the purpose of providing motion to elements in the presentation of graphic images. The invention provides a means to generate unique alternating motion in movable structures that are part of a graphic image.

The Helms U.S. Pat. No. 3,559,321 mentioned above presents devices that use movable paper components to shift elements from one location to another. However, as the resultant movement in Helms' occurs at the same rate and constancy of direction as the input movement, the devices are predictable in their animating capacity. The Maher U.S. Pat. No. 3,486,270 is also limited in a similar regard; movement to operate her device is directly leveraged, and thus, the resulting movement is simply equivalent. Generally speaking, in the prior art, published and otherwise, the pop-up or sliding movement of elements proceeds in singular paths of undeviated direction in direct relation to the opening, or closing, of a card or book or the pushing and pulling of a tab. Whatever the precise merits, features, and advantages of the above cited references, none of them achieves or fulfills the primary objective of my alternating motion invention.

It is an object of this invention to be a means for generating animation that is unique to the field in a form that is highly versatile, physically thin, and is made of materials typical to graphical arts media. Other objects of the invention are for the embodiments to be capable of easy modification for changing the types of movement and types of graphical elements that are animated. And in addition, it is an object to have embodiments that are self-contained so they may be utilized in numerous applications with a minimum of external modification. The device described herein produces a varied alternating motion from the application of pulling and pushing motion and creates a novel surprise effect. The device is also capable of producing a wide range of choreographed movements beyond simple reciprocation. The action-producing portion of the device is a self-contained unit and as such may manifest itself in a single form that can be installed in a variety of applications. The self-contained unit is not dependent on a folding greeting card or book environment in order to function, either physically or as a communication medium. Within a single form, however, wide variations are possible, and as such, standardization of major parts will contribute to lower production cost and allow for a broad product base through interchangeable minor parts, the minor parts being the elements that vary the products effects.

One of these elements, a track, determines the choreography of movement produced by the device and can easily be varied in the manufacturing process to change the choreography. Another element is the graphical component that is the animated part of the device. In most embodiments, this component is linked to the animating source at only one point and is easily interchangeable. And, as a result of the compact, self-contained, and multi-application form, new animated products may be developed that are currently not available in the prior art, such as wearable animated-paper novelties or animated package design components. Further objects and advantages of my invention will become apparent from a consideration of the drawings and ensuing description.

BRIEF DESCRIPTION OF THE DRAWINGS

FIG. 16 is a side view of the assembled appendage of the tracking member in FIG. 11.

FIG. 17 is a plan view of the assembled components of FIGS. 11, 12, and 13.

REFERENCE NUMERALS IN DRAWINGS

Figure 1:
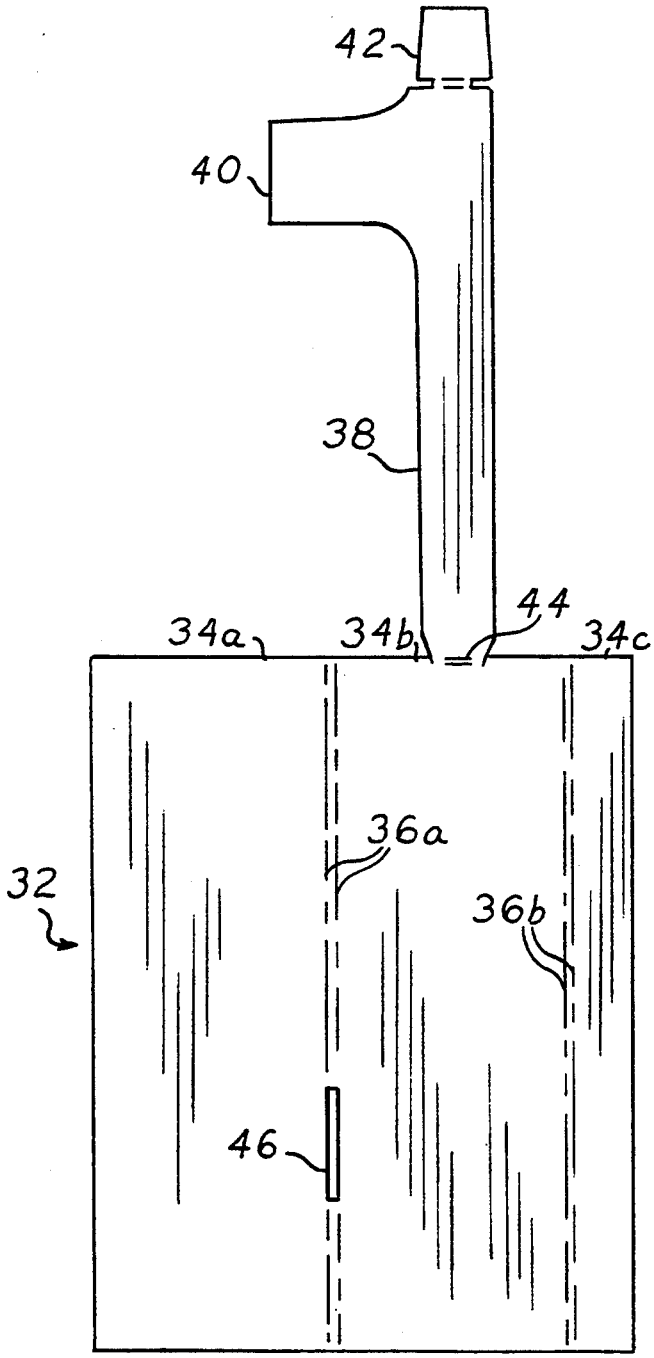
FIG. 1 is a plan view of an unassembled guidance structure of the preferred embodiment.

| | | | |
|---|---|---|---|
| 32. | guidance structure | 68a. | slot |

-continued

REFERENCE NUMERALS IN DRAWINGS

| | | | |
|---|---|---|---|
| 34a. | cover panel | 68b. | slot |
| 34b. | center panel | 70. | tape |
| 34c. | edge panel | 72. | double-sided tape |
| 36a. | foldlines | 74. | tape |
| 36b. | foldlines | 76. | double-sided tape |
| 38. | tracking member | 78. | tab strip |
| 40. | foot | 80a. | double-sided tape |
| 42. | appendage | 80b. | double-sided tape |
| 44. | attachment joint | 82. | tracking member |
| 46. | rectangular aperture | 84. | flaps |
| 48. | reaction member | 86. | foot |
| 50. | foldline | 88. | narrow appendage |
| 52. | track | 90. | guidance structure |
| 54. | cover | 92a. | cover panel |
| 56. | graphical structure | 92b. | center panel |
| 58a. | right half | 92c. | edge panel |
| 58b. | left half | 94a. | foldlines |
| 60. | outer tab | 94b. | foldlines |
| 62. | slot-shaped aperture | 96. | slide interface |
| 64. | inner tab | 98. | guard |
| 66. | card | 100a. | attachment tabs |
| 100b. | attachment tabs | 138. | foldline |
| 102. | circular aperture | 140. | track |
| 104. | rectangular aperture | 142. | cover |
| 106. | foldline | 144. | guidance structure |
| 108. | reaction member | 146a. | cover panel |
| 110. | foldline | 146b. | center panel |
| 112. | track | 146c. | edge panel |
| 114. | cover | 148a. | foldline |
| 116. | tape | 148b. | foldline |
| 118. | double-sided tape | 150. | tracking member |
| 120. | guidance structure | 152. | foot |
| 122a. | cover panel | 154. | appendage |
| 122b. | center panel | 156. | attachment joint |
| 122c. | upper edge panel | 158. | rectangular aperture |
| 122d. | lower edge panel | 160. | reaction member |
| 124a. | foldlines | 162. | foldline |
| 124b. | foldlines | 164. | track |
| 124c. | foldlines | 166. | cover |
| 126. | tracking member | 168. | guidance structure |
| 128. | attachment joint | 170a. | cover panel |
| 130. | foot | 170b. | center panel |
| 132. | appendage | 170c. | edge panel |
| 134. | rectangular aperture | 172a. | foldlines |
| 136. | reaction member | 172b. | foldlines |
| 174. | left tracking member | 216. | eye |
| 176. | right tracking member | 218. | actuation plate |
| 178. | foot | 220. | linkage |
| 180. | appendage | 222. | slot-shaped aperture |
| 182. | attachment joint | 224. | round aperture |
| 184. | rectangular aperture | 226. | plane |
| 186. | foot | 228. | slot-shaped aperture |
| 188. | appendage | 230. | tapes |
| 190. | attachment joint | 232. | aperture |
| 192. | rectangular aperture | | |
| 194. | circular aperture | | |
| 196. | reaction member | | |
| 198a. | left track | | |
| 198b. | middle track | | |
| 198c. | right track | | |
| 200. | cover | | |
| 202. | tracking member | | |
| 204. | flaps | | |
| 206. | appendage | | |
| 208. | tapes | | |
| 210. | graphical structure | | |
| 212. | body | | |
| 214. | fin | | |

DESCRIPTION OF THE PREFERRED EMBODIMENT

1. Referring to FIG. 1, a guidance structure (32) is the main structure of the device and is preferably made of paper card stock. Guidance structure (32) is divided into three panels (**34*a*,34*b*,34*c*) by parallel foldlines (36*a*,36*b*) and also has a tracking member (38) as one of its elements. Cover panel (34*a***) is rectangularly shaped and has a right edge of two parallel foldlines (36*a*) that mark its attachment to center panel (34*b*). Center panel (34*b*) has substantially the same dimensions as cover panel (34*a*) and center panel (34*b*) has as its right edge two parallel foldlines (36*b*) that mark its attachment to edge panel (34*c*). Edge panel (34*c*) is the same length as center panel (34*b*) but is dimensionally less than half of its width.

Joined to center panel (34*b*) at its top edge and extending upwardly therefrom, in the unassembled form, is a tracking member (38). Tracking member (38) is a flat, inverted boot-shaped attachment with a leg portion that is approximately one-third the width of center panel (34*b*); the overall length of tracking member (38) is approximately the same as center panel (34*b*). The foot (40) of this boot shape extends left from the center of tracking member (38) and terminates in a squared-off end.

At the top end of tracking member (38) is a foldably attached appendage (42) that is notched at its left and right attachment edges to enable it to slidably engage in another component of the preferred embodiment. Tracking member (38) is joined to center panel (34*b*) with a flexible attachment joint (44) that permits folding and a limited amount of pivoting movement of tracking member (38) relative to panel (34*b*). Between the two parallel foldlines (36*a*) that separate cover panel (34*a*) from center panel (34*b*), is a rectangular aperture (46) that is dimensioned to slidably receive the end of foot (40) when foot (40) is folded down to that location during assembly.

Figure 2:
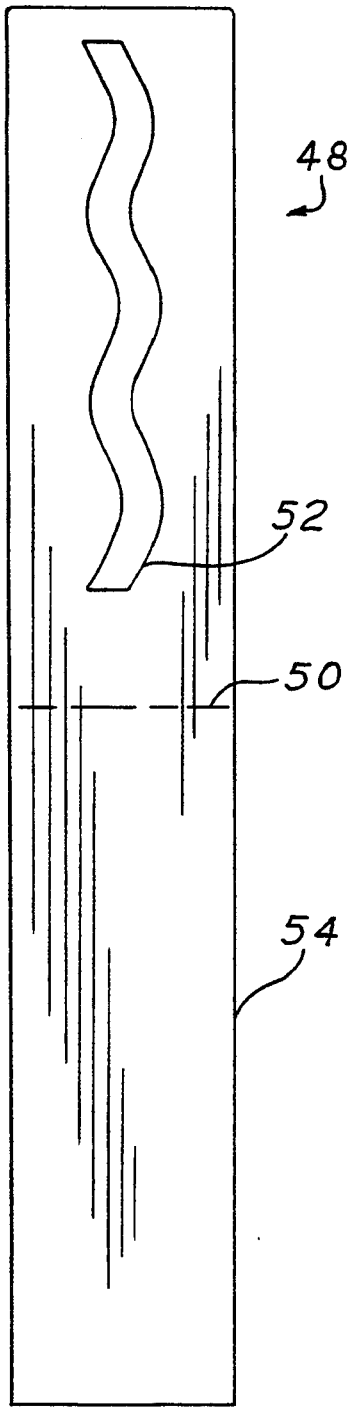
FIG. 2 is a plan view of an unassembled reaction member of the preferred embodiment.

Referring to FIG. 2, the second component of the preferred embodiment is a reaction member (48) that is a long, narrow rectangular shape and is dimensioned in its width to fit between fold lines (36*a*,36*b*, FIG. 1) so that when cover panel (34*a*) and edge panel (34*c*) are folded over center panel (34*b*) with reaction member (48) inside, the reaction member will easily slide within guidance structure (32) in a controlled, linear motion. Reaction member (48, FIG. 2) is divided in it's length into two halves by a foldline (50). The upper half holds a track (52) and the lower half functions as a decorative cover (54). Cut through the upper half of reaction member (48) is track (52) that is a symmetrical, serpentine-shaped aperture that has parallel curving edges and is dimensioned in it's width to slidably receive the notched appendage (42, FIG. 1). The lower half, cover (54, FIG. 2) is folded on top of the upper half in assembly and hides the track (52) from view.

Figure 3:
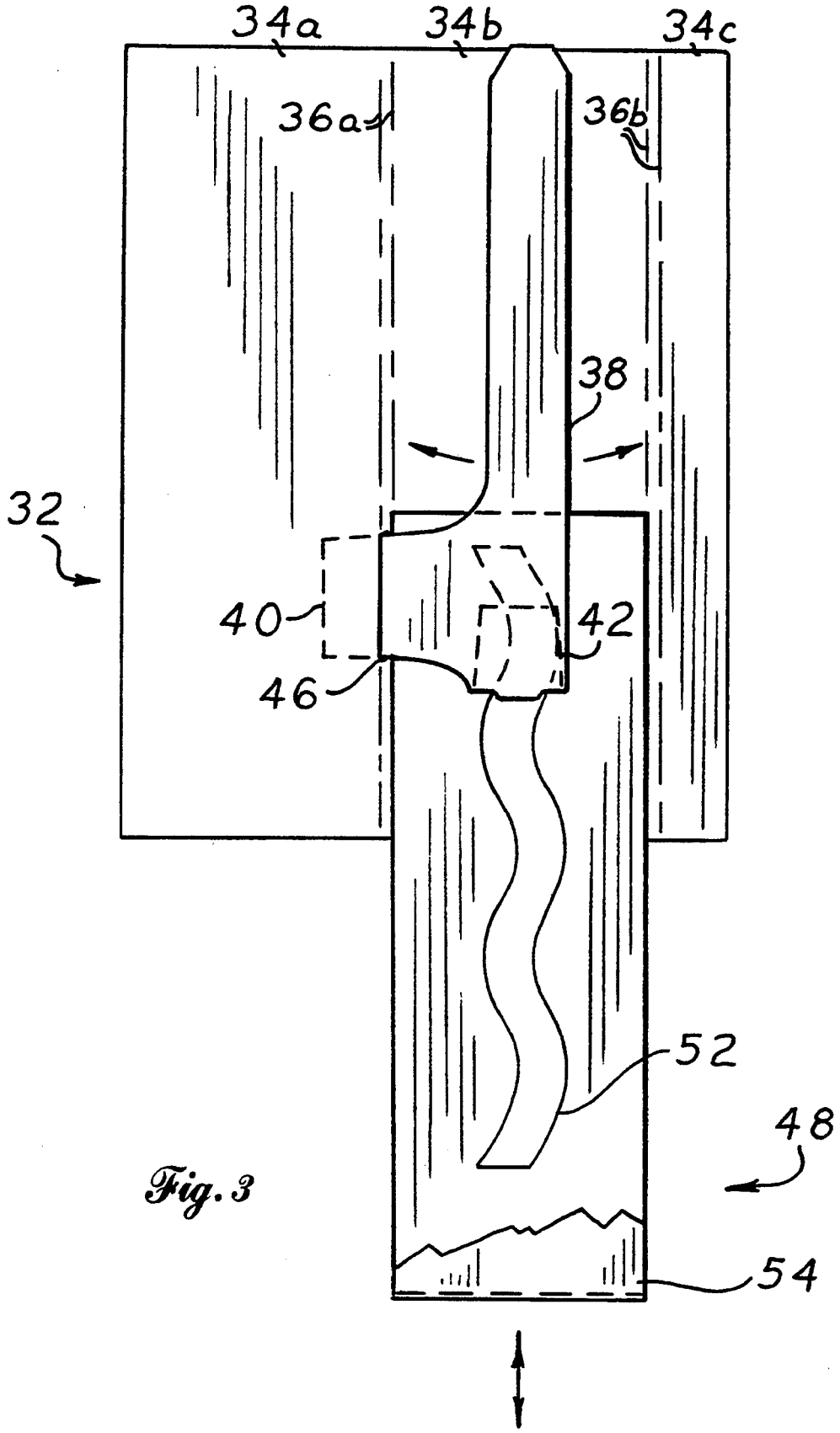
FIG. 3 is a plan view of the partially assembled components in FIGS. 1 and 2.

Referring to FIG. 3, in the process of assembly appendage (42) is folded onto tracking member (38) which itself is folded onto center panel (34*b*). Appendage (42) is fitted through track (52) in reaction member (48) and the reaction member is aligned between foldlines (36*a*,36*b*). Foot (40) is inserted through rectangular aperture (46) in guidance structure (32). Reciprocating action can be achieved at the foot (40) end of tracking member (38) when the lower half of reaction member (48) is folded on top of the upper half, the panels (34*a*,34*c*) are folded over, and reaction member (48) is pushed and pulled through the folded guidance structure (32) forcing alternating movement not unlike a pendulum in tracking member (38).

Figure 4:
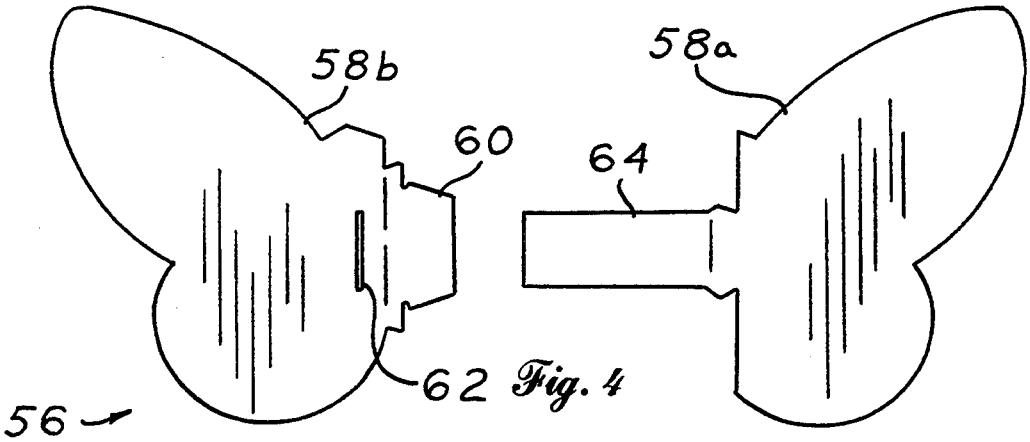
FIG. 4 is a plan view of an unassembled graphical structure.

Referring to FIG. 4, a graphical structure (56) in this embodiment is in the form of a butterfly and consists of a right half (58*a*) and a left half (58*b*). Left half (58*b*) is shaped like a butterfly wing with an outer tab-like plane, outer tab (60), extending from the inner-wing edge and ending in a generally squared-off form. At the so called inner-wing edge is a slot-shaped aperture (62), and to the immediate right of aperture (62) and parallel to it, is a foldline that bisects outer tab (60). Outer tab (60) has two symmetrical notches on it's upper and lower edges.

Figure 5:
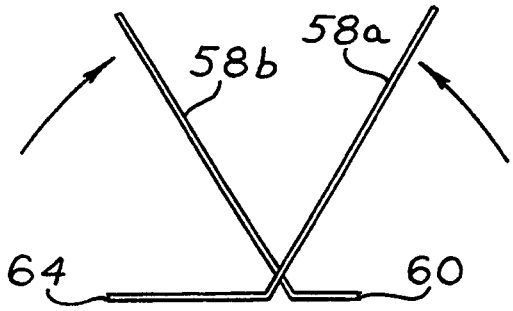
FIG. 5 is an end view of the assembled graphical structure in one position of operation.
Figure 6:
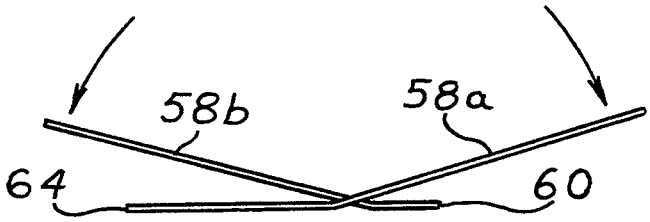
FIG. 6 is an end view of the assembled graphical structure in another position of operation.
Figure 7:
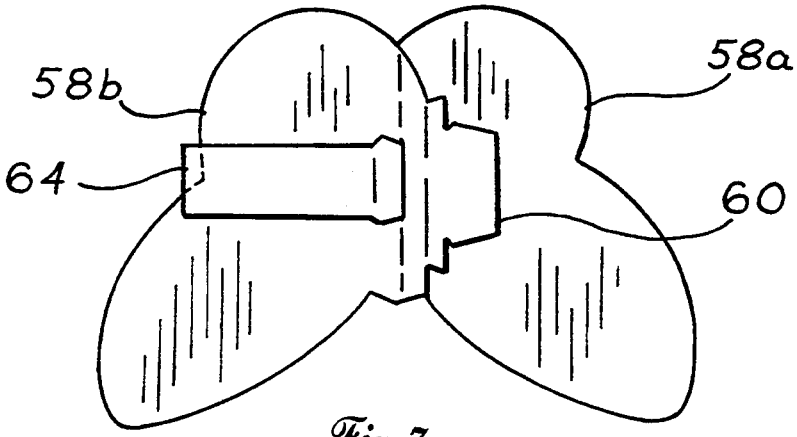
FIG. 7 is a bottom view of the assembled graphical structure rotated 90 degrees from the view in FIG. 6.

Right half (58*a*) is a mirror-image shape of left half (58*b*) in the portion that is shaped like a butterfly wing. Right half (58*a*) also has an inner tab-like plane, inner tab (64), extending from it's inner-wing edge and it terminates in a squared-off end. Inner tab (64) has two bumps on its outside upper and lower edges and is dimensioned in it's width to lock into the slot-shaped aperture (62). Inner tab (64) is also bisected by a foldline that runs parallel and to the immediate left of the inner-wing edge. Graphical structure (56) is assembled by inner tab (64) on right half (58*a*) being inserted into aperture (62) on the left half of the graphical structure (58*b*) and being pulled through until the two inner-wing edges meet. Referring to FIGS. 5 and 6, the two assembled halves (58*a*,58*b*) react against each other in a scissors-like manner when their tab portions (60,64) are pushed and pulled toward and away from each other in a controlled manner making a movement imitative of fluttering wings. FIG. 7 shows the assembly relationship of graphical structure (56) in a plan view looking up at the bottom of the assembly.

Figure 8:
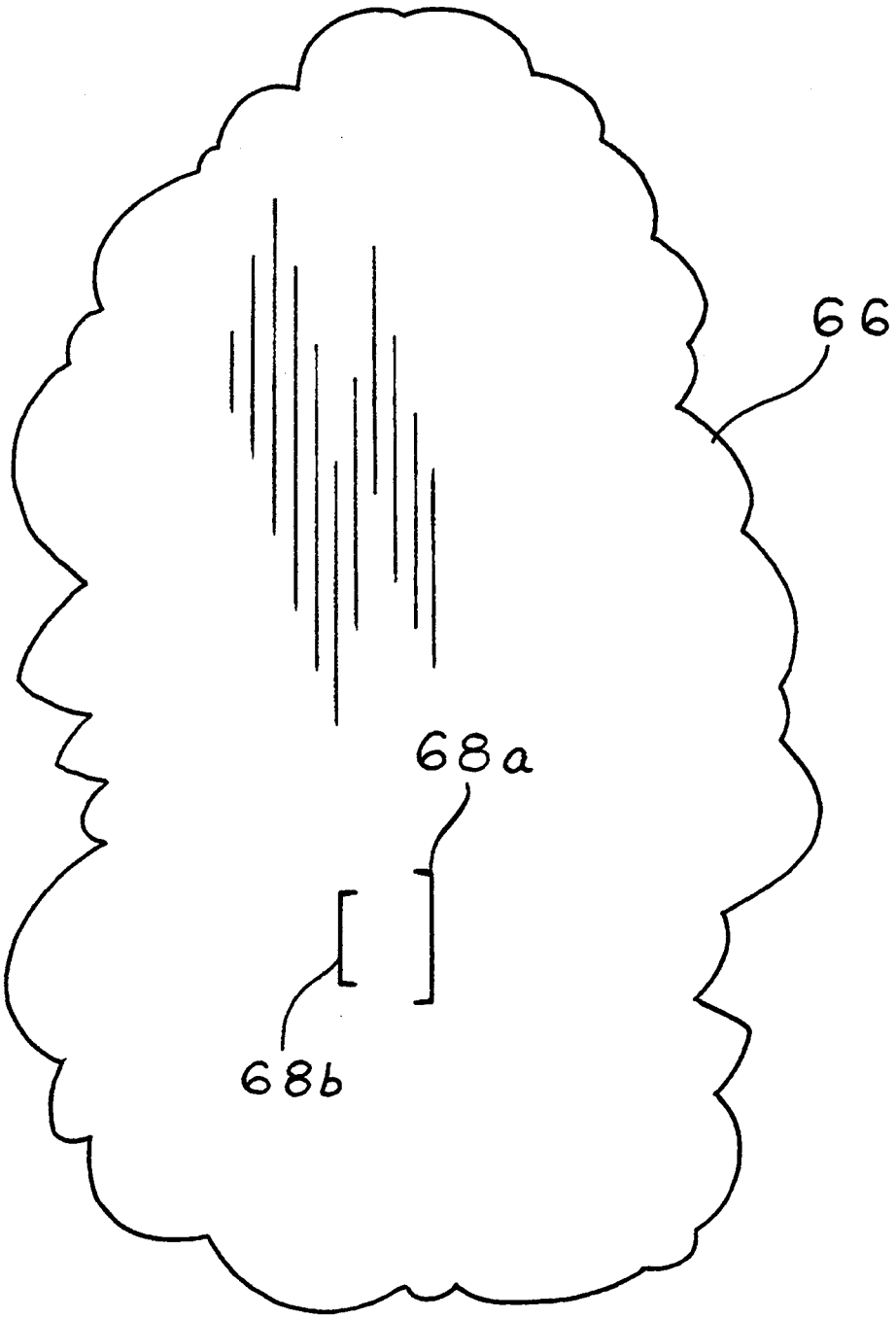
FIG. 8 is a plan view of a decorative card element.

Referring to FIG. 8, another element of the preferred embodiment is a card (66) that functions as a decorative cover to enhance the appearance of the device. Card (66) is typically imprinted with an image that visually compliments graphical structure (56, FIG. 7) and is shaped to the silhouette of the visual image; in this embodiment the silhouette is of a bouquet of flowers and leaves. Cut into card (66, FIG. 8) are two slots (68*a*,68*b*) that function as holding and controlling features for graphical structure (56). One slot (68*a*) is dimensioned to interlockingly hold the wider outer tab (60,FIG. 7) on graphical-structure left half (58*b*) and the other slot (68*b*,FIG. 8) is dimensioned to allow the narrower inner tab (64,FIG. 7) on graphical-structure right half (58*a*) to easily slide through it in a controlled motion.

Figure 9:
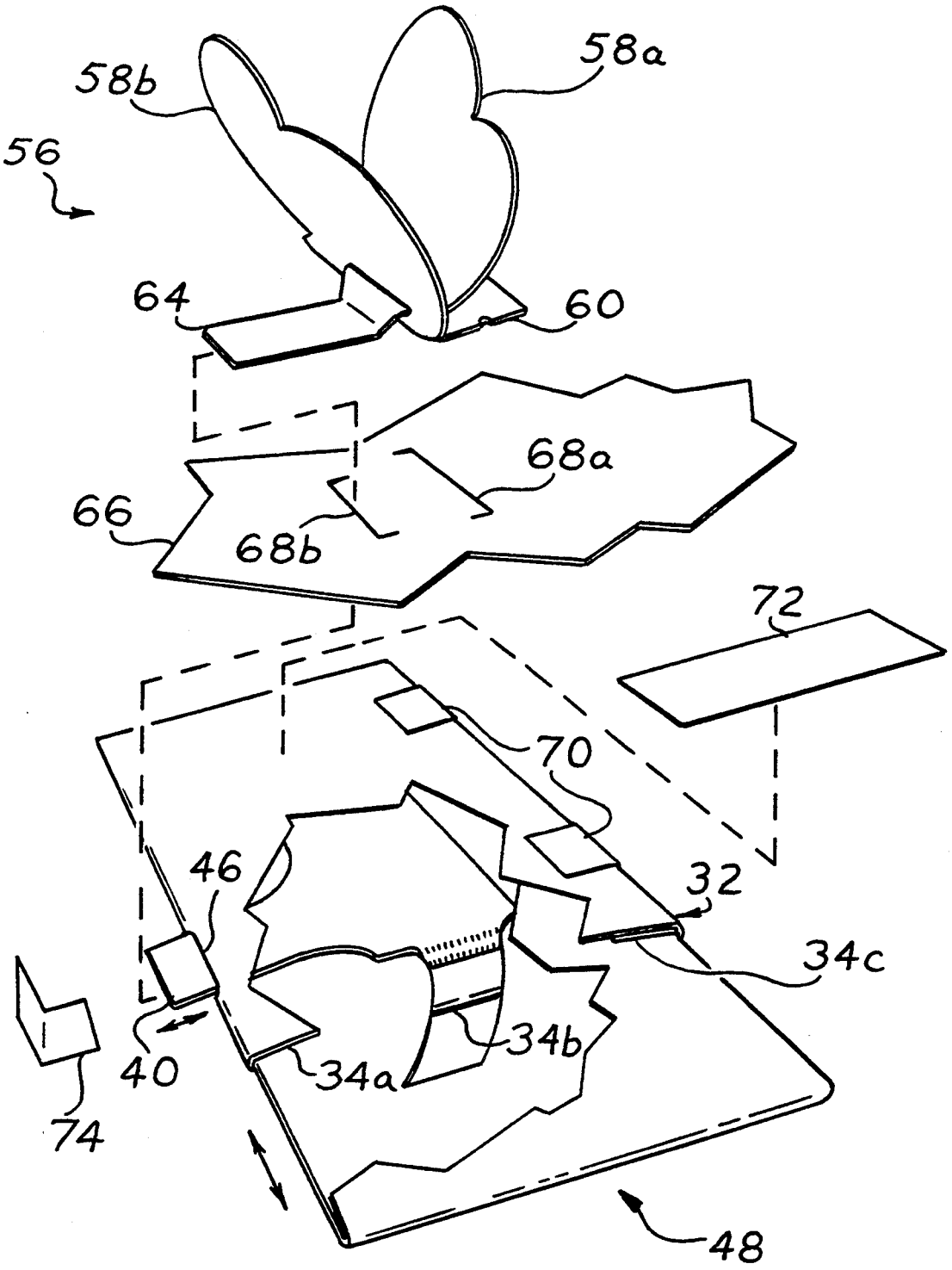
FIG. 9 is a partially exploded view of the preferred embodiment showing a cutaway view of two of the moving elements and the assembly relationship of all the components.

The relationship of all parts in the preferred embodiment is shown in FIG. 9. The components of this embodiment are assembled into final working relationship with tabs (60,64) on graphical structure (56) inserted into slots (68*a*,68*b*) on the card (66, shown in partial view in FIG. 9), pieces of tape (70) adhered to guidance structure (32) to hold together structure cover panel (34*a*) and center panel (34*b*) in a closed position, and double-sided tape (72) adhering guidance structure (32) to card (66) so that inner tab (64) is aligned with foot (40). Foot (40) is connected to graphical-structure inner tab (64) with a piece of tape (74).

The assembled device is operated by holding card (66) in a fixed position and pulling and pushing reaction member (48) in a linear motion. This causes reciprocating movement in foot (40) attached to graphical-structure inner tab (64) and in turn causes a scissors-like movement in graphical structure (56). The end effect is that of a butterfly fluttering its wings.

Figure 10:
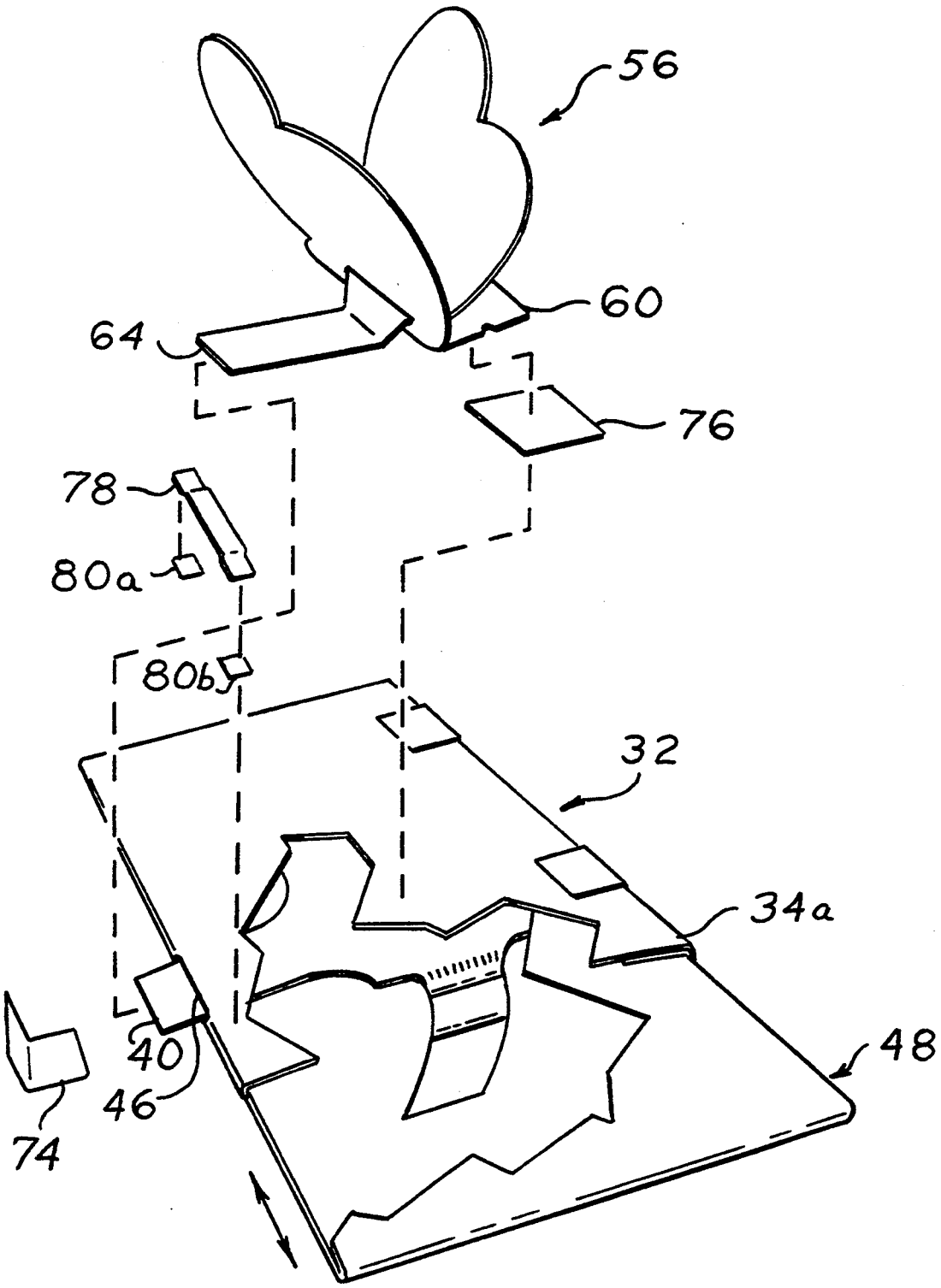
FIG. 10 is a partially exploded view of the first alternate embodiment showing a cutaway view of two of the moving elements and the assembly relationship of all the components.

2. Although the device of FIG. 9 is considered to be the preferred embodiment, alternate embodiments are possible. In the selection of graphical imagery it may be desired to have a device without a decorative card (66). Referring to FIG. 9 and then to FIG. 10, modifications are shown that make an alternate embodiment possible that is configured without the card (66). With the preferred embodiment as the basic form of the device (FIG. 9), two elements are subtracted: card (66) and double-sided tape (72). Referring to FIG. 10, a piece of double-sided tape (76) cut to the same dimensions as outer tab (60) is used as an adhesive to connect outer tab (60) directly to cover panel (34*a*). A tab strap (78), which is a narrow strip approximately one and one-half times longer than the width of inner tab (64) is used to secure inner tab (64) in a moving relation to cover panel (34*a*). Two square bits of double-sided tape (80*a*,80*b*) secure the tab strap (78) at both ends to cover panel (34*a*) so that inner tab (64) can easily slide under tab strap (78). Tab strap (78) is centered, parallel, and adjacent to rectangular aperture (46) on the outer surface of cover panel (34*a*) during assembly.

In this alternate embodiment, the elements of the guidance structure (32), reaction member (48), and graphical structure (56) are assembled as recited in the previous description of the preferred embodiment. The final assembly of components in this embodiment however, is completed as follows: tab strap (78) is attached to cover panel (34*a*) using pieces of double-sided tape (80*a*,80*b*). Inner tab (64) is inserted under tab strap (78) and pushed through so its end aligns with end of foot (40). Inner tab (64) and foot (40) are then attached to one another with tape (74). With reaction member (48) pushed fully into guidance structure (32) causing foot (40) to be extended to it's outer most position, and graphical structure (56) flattened, causing outer tab (60) to extend to the greatest distance possible from foot (40), double-sided tape (76) is adhered to the underside of outer tab (60) and that is adhered to cover panel (34*a*) with the alignment perpendicular to the lengthwise centerline of the device. In this particular embodiment, the assembled device is operated by holding guidance structure (32) in a fixed position while pulling, then pushing reaction member (48) in a linear motion.

Figure 11:
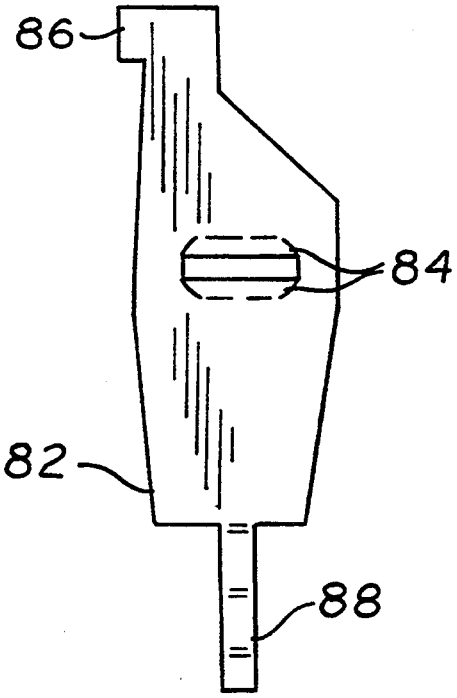
FIG. 11 is a plan view of an unassembled tracking member of the second alternate embodiment.

3. Another alternate embodiment offers features beyond those in the preferred embodiment. In particular, the alternate embodiment shown in FIG. 18 allows for reciprocating movement in locations other than what is afforded by the preferred embodiment and it may offer increased product durability in certain applications. Referring to FIG. 11, the significant difference of the second alternate embodiment is a rotatable tracking member (82).

Rotatable tracking member (82), in it's unassembled form, is an elongated polygon that has in its center an aperture with flaps (84) at the aperture's edge. Tracking member (82) also has a boot-shaped portion extending upwardly from the center terminating in a foot (86), and a narrow appendage (88) with parallel sides extending downward from the bottom edge. Flaps (84) in the center aperture are narrow strips that are foldably attached to opposite sides of the aperture and are notched inwardly at their foldlines in a way that makes tab-like ends on flaps (84). The dimensions of the flaps are such that their tab-like ends will fold into, and the bases of the notches will engage with, a circular aperture at four points.

Figure 12:
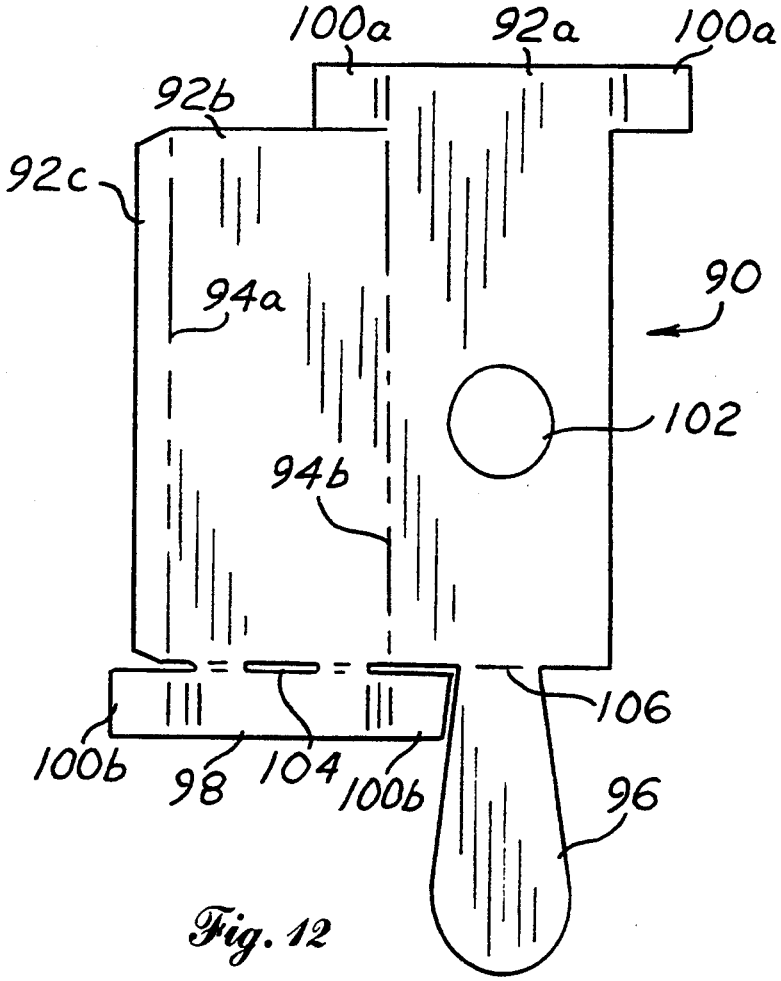
FIG. 12 is a plan view of an unassembled guidance structure of the second alternate embodiment.

Now referring to FIG. 12, in the second alternate embodiment, a guidance structure (90) is divided into three panels (92*a*,92*b*,92*c*) by parallel fold lines (94*a*,94*b*) and also has as unique elements a slide interface (96), a guard (98), attachment tabs (100*a*,100*b*), a circular aperture (102), and a rectangular aperture (104).

Cover panel (92*a*) is rectangularly shaped and has in its middle a circular aperture (102). In the unassembled state, a downwardly extending, tongue-shaped, slide interface (96) connects to cover panel (92*a*) at the panel's lower edge and the connection is marked by a foldline (106). At the top of cover panel (92*a*) are two attachment tabs (100*a*) that are located at the upper left- and right-side edges. The left edge of cover panel (92*a*) is indicated by a foldline (94*b*) that separates it from adjoining center panel (92*b*), which is the same width as cover panel (92*a*) but shorter in height by the width of attachment tabs (100*a*). The plane of center panel (92*b*) is extended downwardly from it's bottom edge to form a foldable guard (98) which is a narrow strip with attachment tabs (100*b*) at either end and a narrow rectangular aperture (104) forming part of the division between guard (98) and center panel (92*b*). The left edge of center panel (92*b*) is indicated by another fold line (94*a*) that separates it from adjoining edge panel (92*c*). Edge panel (92*c*) is a narrow strip that is the same height as center panel (92*b*) but is dimensionally less than half of its width.

Figure 13:
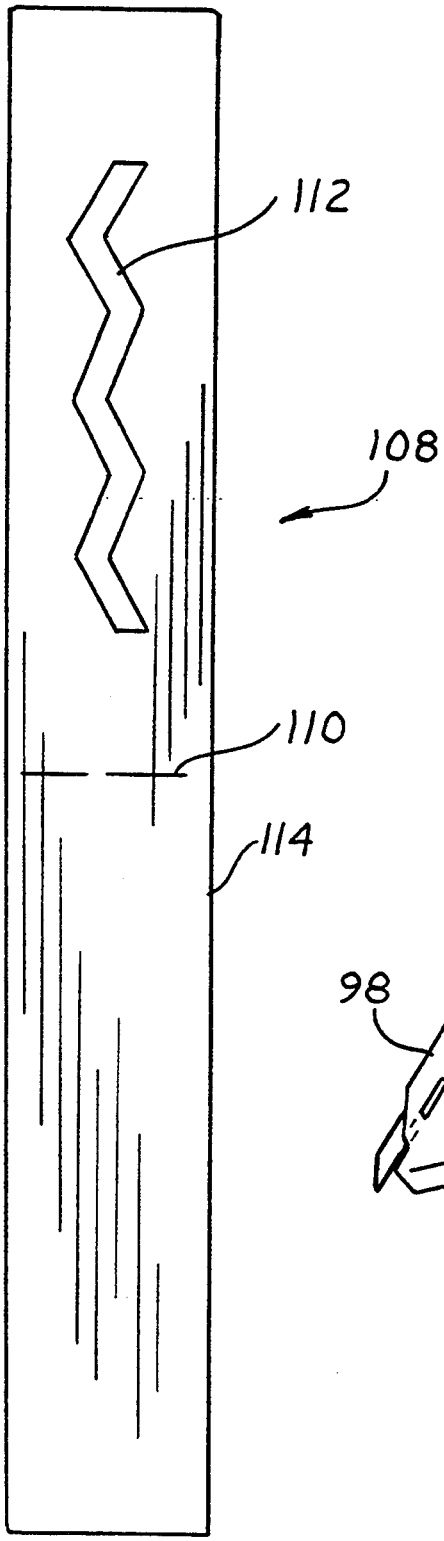
FIG. 13 is a plan view of an unassembled reaction member of the second alternate embodiment.

Please refer to FIG. 13. Another component of this alternate embodiment is a reaction member (108) that is a long, narrow rectangular shape and is dimensioned in its width to fit between fold lines (94*a*,94*b*) that are on guidance structure (90, FIG. 12) so that when cover panel (92*a*) and edge panel (92*c*) are folded over center panel (92*b*) with slide interface (96) folded upwardly with reaction member (108) inside, the reaction member will be able to easily slide within guidance structure (90) in a controlled, linear motion. Reaction member (108, FIG. 13) is divided in it's length into two halves by a foldline (110). The upper half holds a track (112) and the lower half functions as a decorative cover (114). Cut through the upper half of reaction member (108) is a track (112) that is a symmetrical, zigzag-shaped aperture that has parallel edges and is dimensioned in it's width to slidably receive appendage (88, FIG. 11) of tracking member (82). The lower half of reaction member (108), cover (114), is folded on top of the upper half in assembly and hides the track (112) from view.

In this second alternate embodiment, guidance structure (90, FIG. 12) has a slide interface (96) that, in its folded position, prevents interference between flaps (84, FIG. 11) and track (112, FIG. 13) in reaction member (108). This guidance structure (90, FIG. 12) also has a guard (98) that is folded and glued into position to protect the appendage (88) from interference during operation of the device. A circular aperture (102) exists on one surface of the guidance structure (90) into which flaps (84) become foldably engaged to provide a rotatable joint between tracking member (82) and guidance structure (90).

Figure 14:
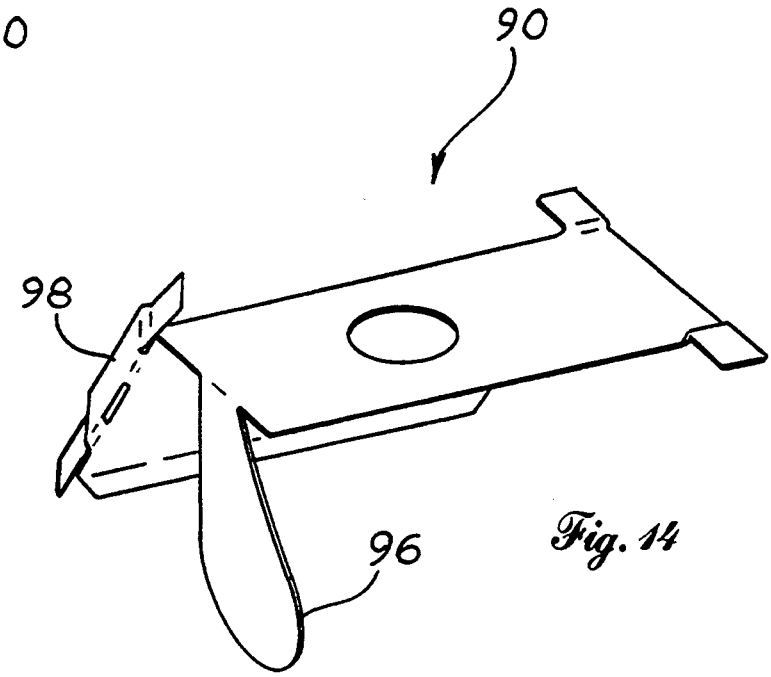
FIG. 14 is a trimetric view of a partially assembled guidance structure of FIG. 12.
Figure 15:
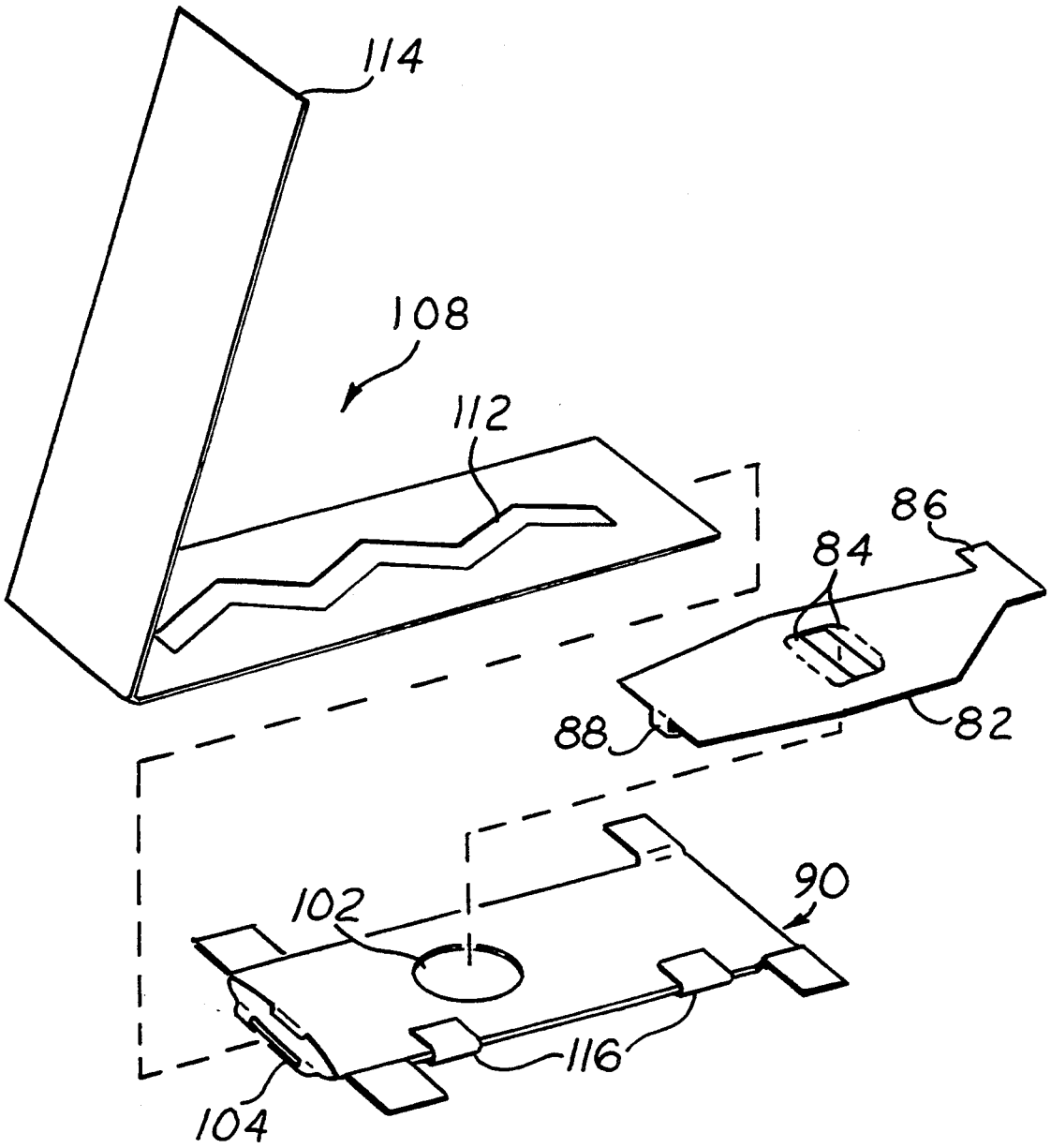
FIG. 15 is a trimetric view of partially assembled components of FIGS. 11, 12, and 13.

Referring to FIG. 14, in the assembly of the embodiment, guard (98) is folded and glued into position and slide interface (96) is folded to the inside of the guidance structure (90). Guidance structure (90) is folded into an envelope form and, referring to FIG. 15, secured in this position with tape (116). Reaction member (108) is then slid into the folded guidance structure (90). Appendage (88) of the tracking member (82) is folded and glued into position as shown in FIG. 16 and then aligned through track (112, FIG. 15) and into rectangular aperture (104) at which point flaps (84) may be positioned directly over circular aperture (102). The flaps are then poked into the circular aperture so their corner edges engage with the edge of the circular aperture thereby creating a rotatable attachment. Refer to FIG. 17 for a top view of the assembled parts (82,90,108). Back and forth movement of reaction member (108) will cause reciprocating motion at foot (86). At this point in the assembly process, the lower half of reaction member (108), cover (114), should be folded up on top of tracking member (82).

Figure 18:
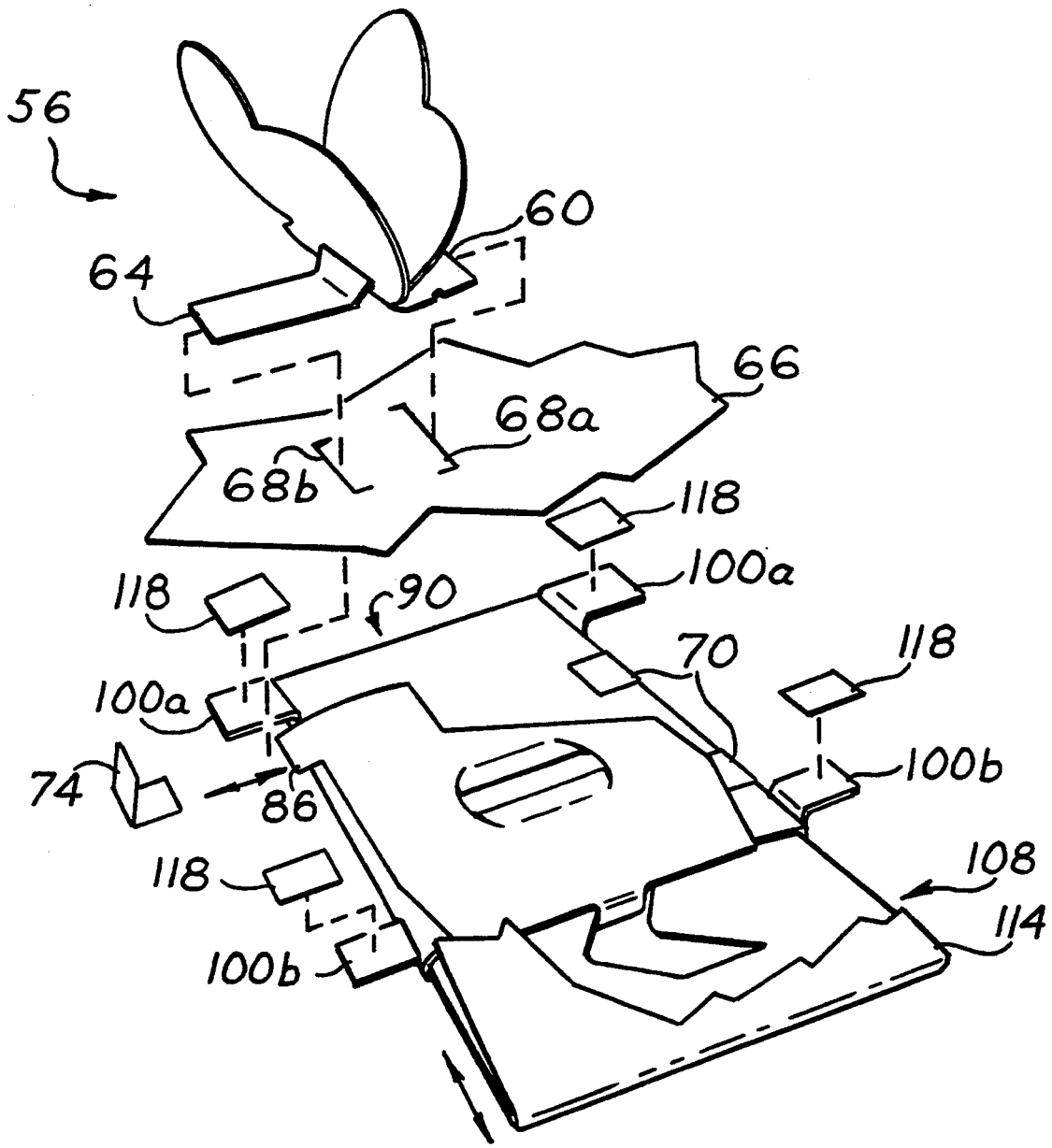
FIG. 18 is a partially exploded view of the second alternate embodiment showing the assembly relationship of all the elements in the embodiment.

Referring to FIG. 18, other elements in this embodiment, graphical structure (56), card (66), and tapes (70,74), are the same elements as described in the recitation of the preferred embodiment and are used similarly herein. The final assembly of components in the second alternate embodiment parallels that of the preferred embodiment. Graphical structure (56) is the same configuration on both the second alternate embodiment and the preferred embodiment. Refer to paragraph 1 in this section for the assembly of graphical structure (56). Tabs (60,64) on graphical structure (56) are inserted into slots (68*a*,68*b*) on card (66, shown in partial view), pieces of tape (70) are adhered to guidance structure (90) to hold together the structure in a closed position, and double-sided tape (118) is used to adhere attachment tabs (100*a*,100*b*) to card (66) so that inner tab (64) is aligned with foot (86). Foot (86) is connected to graphical structure inner tab (64) with a piece of tape (74). The second alternate embodiment is operated in the same way as the preferred embodiment.

4. Another alternate embodiment is possible that has a different area of reciprocating movement relative to the moving reaction member which functions in part as a push/pull handle. This third alternate embodiment expands the range of applications for the invention and is a fundamentally simpler design than that of the second alternate embodiment.

Figure 19:
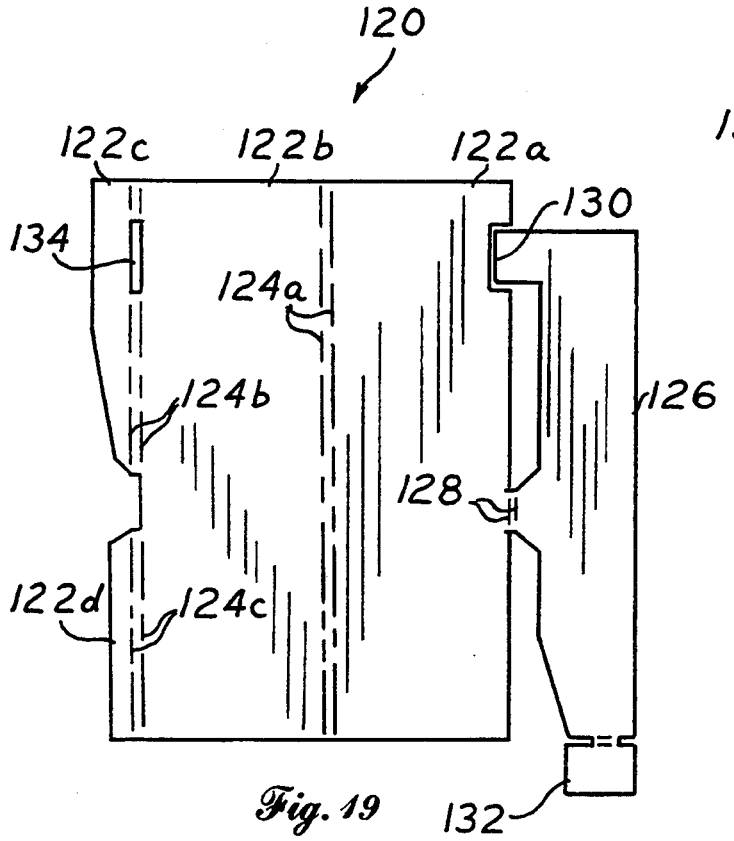
FIG. 19 is a plan view of an unassembled guidance structure of the third alternate embodiment.

Referring to FIG. 19, the guidance structure (120) of the third alternate embodiment is divided into four panels (122*a*,122*b*,122*c*,122*d*) by parallel foldlines (124*a*,124*b*,124*c*) and also has a tracking member (126) as one of its elements. Cover panel (122*a*) is rectangularly shaped and has a left edge of two parallel foldlines (124*a*) that mark it's attachment to center panel (122*b*). Attached to the right center edge of cover panel (122*a*) is a tracking member (126) that is shaped like an inverted boot. Tracking member (126) is joined to cover panel (122*a*) near the center of its long edge with a flexible attachment joint (128) that permits folding and a limited amount of pivoting movement of tracking member (126) relative to cover panel (122*a*). Tracking member (126) has a foot (130) at the top end that extends away from the center of tracking member (126) and toward cover panel (122*a*), in the unassembled state, and terminates in a squared-off end. The squared-off end extends into the rectangular area generally defined by cover panel (122*a*), which has been cut out to allow for the formation of the extension. At the bottom end of tracking member (126) is a foldably attached appendage (132) that is notched at its left and right attachment edges to slidably engage in another component of the third alternate embodiment.

As previously stated, cover panel (122*a*) is attached at it's left edge to center panel (122*b*). Center panel (122*b*) has the same height and width as cover panel (122*a*) and has a left edge of parallel foldlines (124*b*,124*c*) that mark it's attachment to upper and lower edge panels (122*c*,122*d*) respectively. Edge panels (122*c*,122*d*) are separated by a straight-cut edge the same width as that of flexible attachment joint (128). Upper edge panel (122*c*) is less than half the width of adjoining panel (122*b*) and runs from the center edge to the top edge of panel (122*b*). Parallel foldlines (124*b*) that divide the two panels run the same length. Between the two parallel fold lines (124*b*) is a rectangular aperture (134) that is dimensioned to slidably receive foot (130) when foot (130) is folded over to the assembled location. Lower edge panel (122*d*) is substantially the same as upper edge panel (122*c*) and it is separated from upper edge panel (122*c*) by a gap roughly equivalent to the width of flexible attachment joint (128) which seats in between the upper and lower edge panels (122*c*,122*d*) in the assembly of guidance structure (120).

Figure 20:
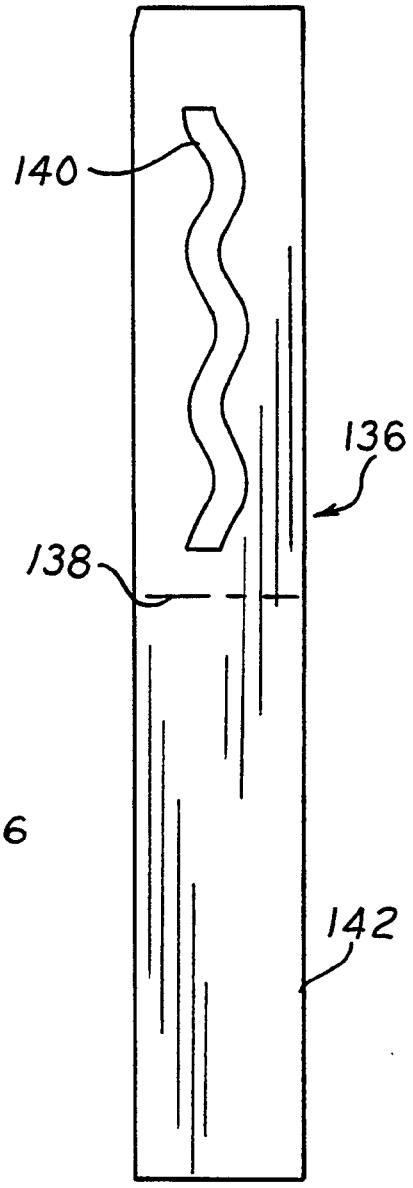
FIG. 20 is a plan view of an unassembled reaction member of the third alternate embodiment.

Referring to FIG. 20, another component of the third alternate embodiment is a reaction member (136) that is a long, narrow rectangular shape and is dimensioned in its width to fit between fold lines (124*a*,124*b*,124*c*, FIG. 19) so that when cover panel (122*a*) is folded over center panel (122*b*) with reaction member (136) and tracking member (126) inside, the reaction member (136) will easily slide within guidance structure (120) in a controlled, linear motion. Reaction member (136, FIG. 20) is divided in its length into two halves by a foldline (138). The upper half holds a track (140) and the lower half functions as a decorative cover (142). Cut through the upper half area of reaction member (136) is track (140) that is a symmetrical, serpentine-shaped aperture that has parallel curving edges and is dimensioned in it's width to slidably receive the notched appendage (132). The lower half of reaction member (136, FIG. 20), cover (142), is folded on top of the upper half in assembly and hides the track (140) from view.

Figure 21:
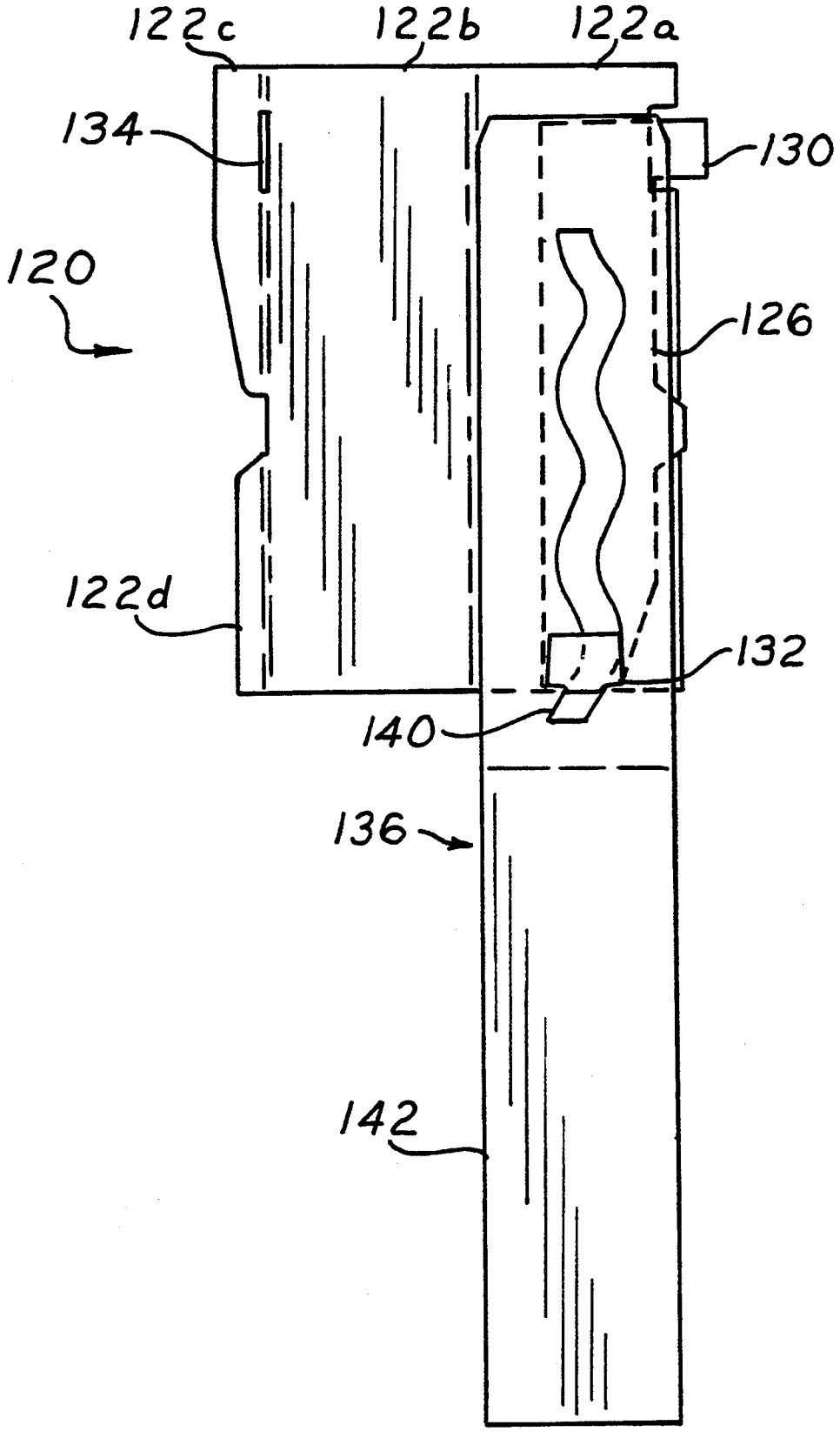
FIG. 21 is a plan view of the partially assembled components of FIGS. 19 and 20.

Referring to FIG. 21, in the process of assembly, tracking member (126) is folded onto cover panel (122*a*) and appendage (132) is folded up onto tracking member (126). Appendage (132) is fitted through track (140) in reaction member (136) and the reaction member is aligned between the left and right edges of cover panel (122*a*). Cover (142) is folded on top of the upper half of reaction member (136). The guidance structure (120) is then folded closed with cover panel (122*a*), tracking member (126), and reaction member (136) being folded over together onto center panel (122*b*) and upper and lower edge panels (122*c*, 122*d*) being folded and tucked in between cover panel (122*a*) and tracking member (126) with foot (130) being inserted through aperture (134) in the process. Other elements in this embodiment, graphical structure (56, FIG. 22), card (66), double-sided tape (72), and pieces of tape (70,74), are the same elements as described in the recitation of the preferred embodiment and are used similarly herein.

Figure 22:
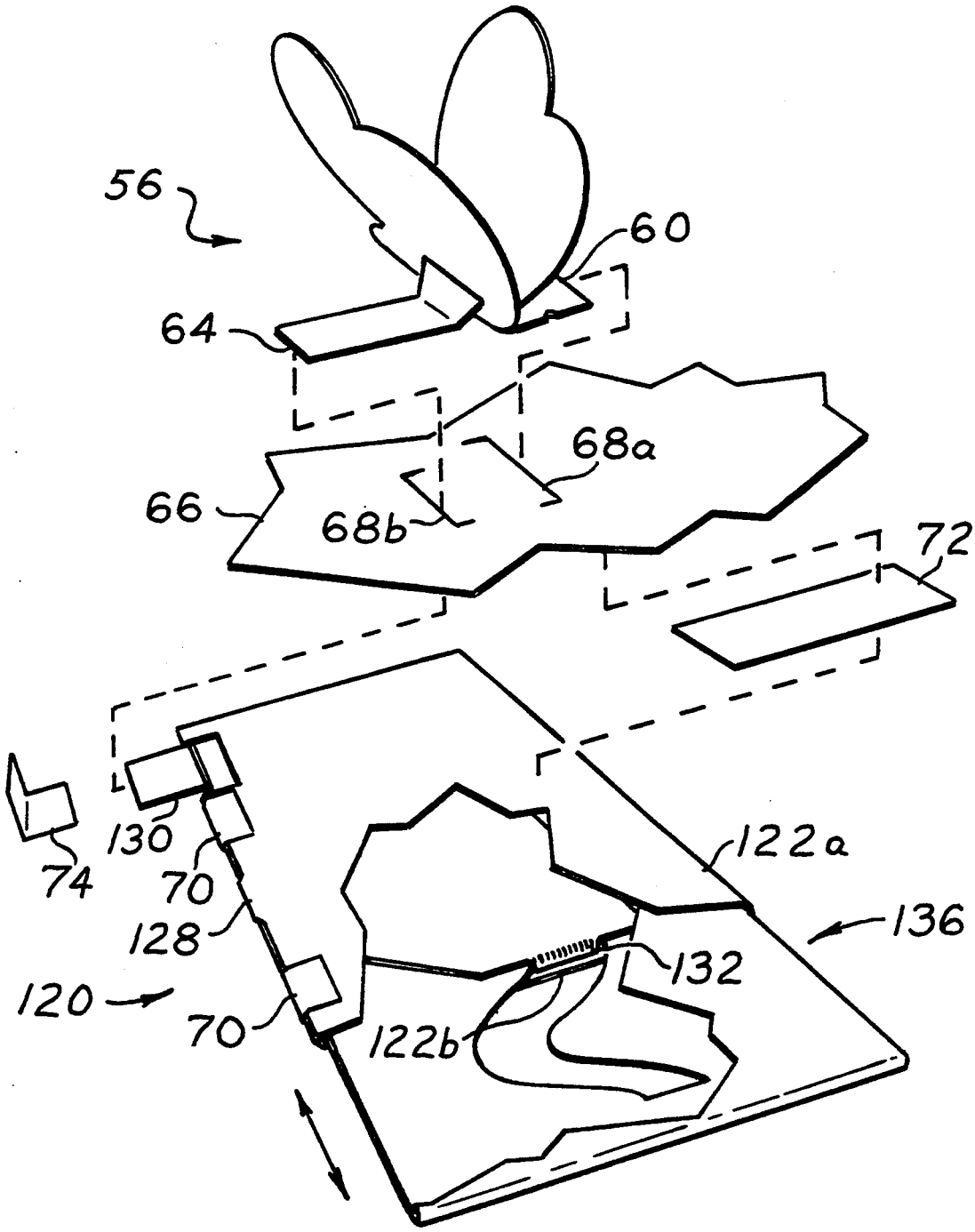
FIG. 22 is a partially exploded view of the third alternate embodiment showing a cutaway view of two of the moving elements and the assembly relationship of all the components.

The relationship of all parts in this embodiment is shown in FIG. 22. The components of this embodiment are assembled into final working relationship with tabs (60,64) on graphical structure (56) inserted into slots (68*a*,68*b*) on the card (66, shown in partial view in FIG. 22), pieces of tape (70) adhered to guidance structure (120) to hold together structure cover panel (122*a*) and center panel (122*b*) in a closed position, and double-sided tape (72) adhering guidance structure (120) to card (66) so that inner tab (64) is aligned with foot (130). Foot (130) is connected to graphical-structure inner tab (64) with a piece of tape (74). The assembled device is then operated in a similar way as the device in the preferred embodiment.

Figure 23:
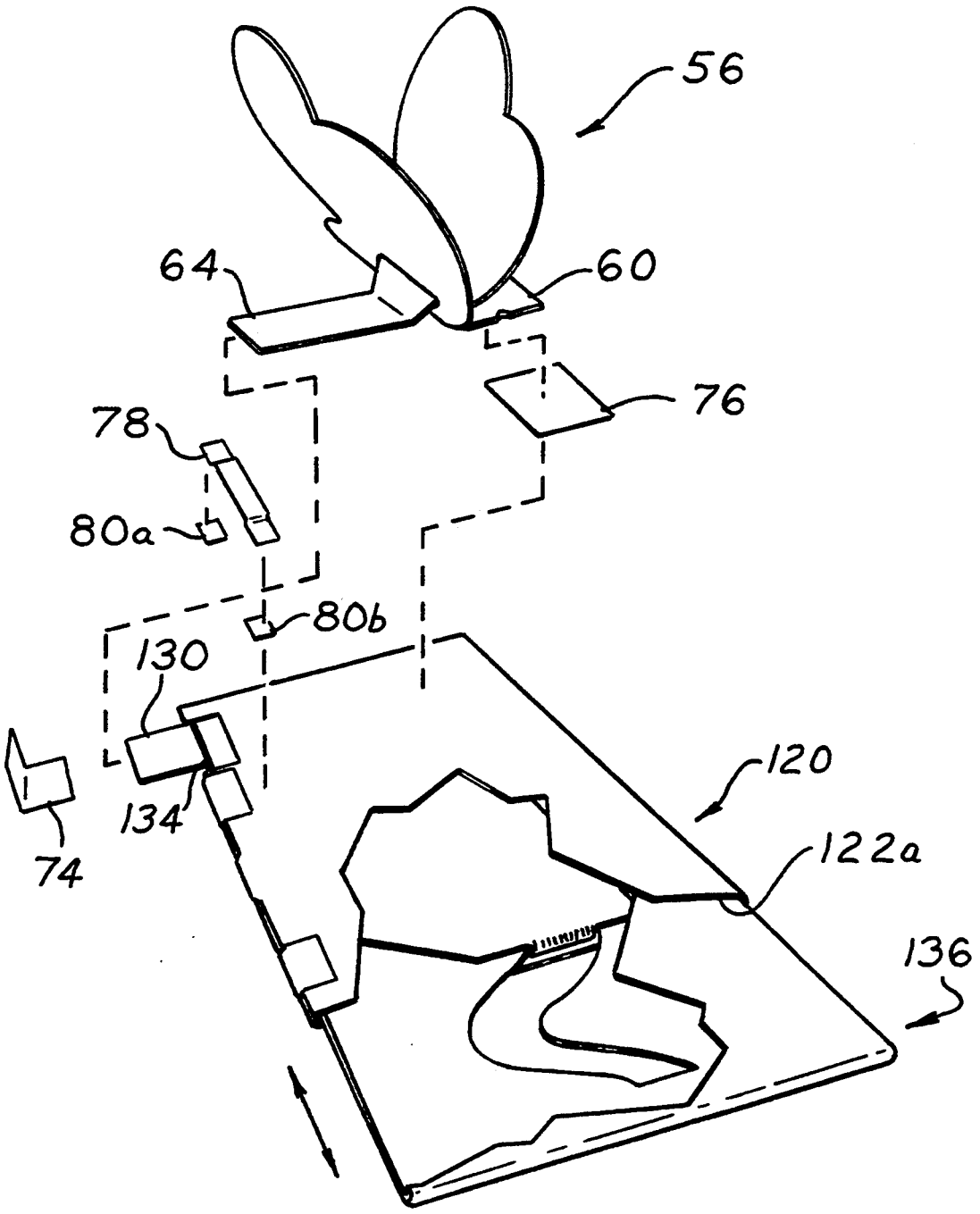
FIG. 23 is a partially exploded view of the forth alternate embodiment showing a cutaway view of two of the moving elements and the assembly relationship of all the components.

5. As the preferred embodiment has an alternate embodiment that is substantially the same in its mechanisms, the embodiment just recited is also capable of a similar modification; that is to say, a device with the decorative card (66) eliminated. The description that follows is almost identical to the description for the first alternate embodiment, which is shown in FIG. 10, with the exception that reference numbers refer to items in FIG. 23. With the third alternate embodiment as the basic form of the device (FIG. 22), two elements are subtracted: card (66) and double-sided tape (72). Referring to the forth alternate embodiment shown in FIG. 23, a piece of double-sided tape (76) cut to the same dimensions as outer tab (60) is used as an adhesive to connect outer tab (60) directly to cover panel (122*a*). A tab strap (78), which is a narrow strip approximately one and one-half times longer than the width of inner tab (64) is used to secure inner tab (64) in a moving relation to cover panel (122*a*). Two square bits of double-sided tape (80*a*,80*b*) secure the tab strap (78) at both ends to cover panel (122*a*) so that inner tab (64) can easily slide under tab strap (78). Tab strap (78) is centered, parallel, and adjacent to rectangular aperture (134) on the outer surface of cover panel (122*a*) during assembly.

In this alternate embodiment, the elements of the guidance structure (120), reaction member (136), and graphical structure (56) are assembled as recited in the previous description of the third alternate embodiment. The final assembly of components in this embodiment however, is completed as follows: tab strap (78) is attached to cover panel (122*a*) using pieces of double-sided tape (80*a*,80*b*). Inner tab (64) is inserted under tab strap (78) and pushed through so it's end aligns with end of foot (130). Inner tab (64) and foot (130) are then attached to one another with tape (74). With reaction member (136) pushed fully into guidance structure (120) causing foot (130) to be extended to its outer most position, and graphical structure (56) flattened, causing outer tab (60) to extend to the greatest distance possible from foot (130), double-sided tape (76) is adhered to the underside of outer tab (60) and that is adhered to cover panel (122*a*) with the alignment perpendicular to the lengthwise centerline of the device. In this particular embodiment, the assembled device is operated by holding guidance structure (120) in a fixed position while pulling, then pushing reaction member (136) in a linear motion.

6. Still another variation of the invention is possible that allows it to be created in a more compact form. In this form the reaction member, which actuates the mechanism, works by a side-to-side action rather than in the primarily up-and-down action of the previously described embodiments. For the sake of organization it is referred to as the fifth alternate embodiment.

Figure 24:
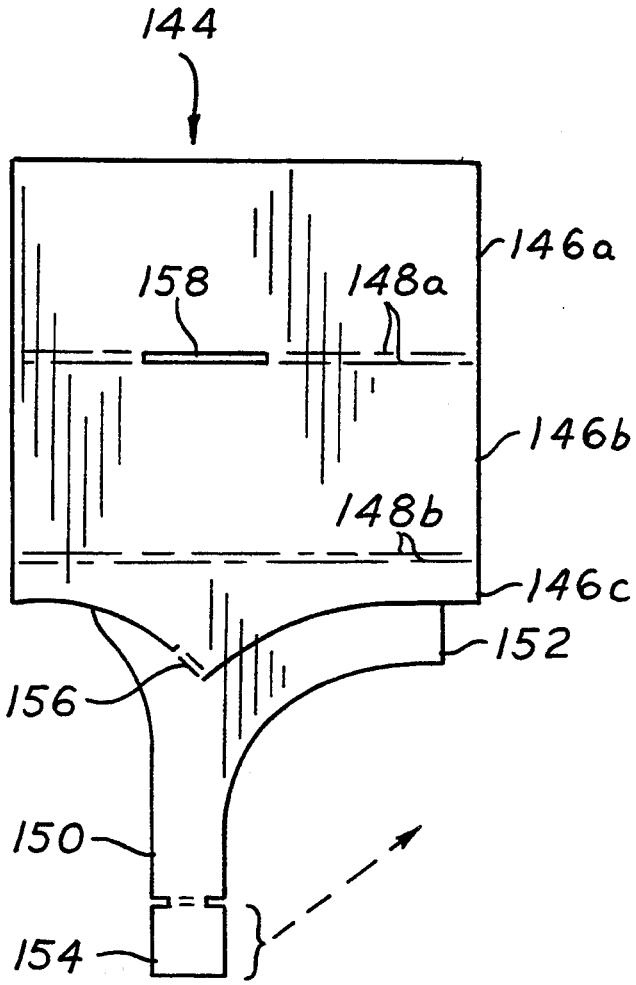
FIG. 24 is a plan view of an unassembled guidance structure of the fifth alternate embodiment.

Referring to FIG. 24, a guidance structure (144) is the main structure of the device. Guidance structure (144) is divided into three panels (146*a*,146*b*,146*c*) by parallel foldlines 148*a*,148*b*) and also has a tracking member (150) as one of its elements. Cover panel (146*a*) is rectangularly shaped and has a bottom edge of two parallel foldlines (148*b*) that mark its attachment to center panel (146*b*). Center panel (146*b*) has substantially the same dimensions as cover panel (146*a*) and center panel (146*b*) has as its bottom edge two parallel foldlines (148*b*) that mark its attachment to edge panel (146*c*). Edge panel (146*c*) is the same length as center panel (146*b*) but is dimensionally less than half of it's width and is contoured to a different shape; the bottom edge comprising two curved portions that, on the same plane, curve laterally inward from the left and right edges and then downward and meet in a point which is somewhat off center.

Joined to edge panel (146*c*) at it's bottom edge adjacent to the point and extending laterally and downwardly therefrom in the unassembled form, is a tracking member (150). Tracking member (150) is a flat, inverted boot-shaped attachment with a foot portion that is smaller in area than panel (146*b*). A foot (152) of this boot shape extends laterally from the center of tracking member (150) and terminates in a squared-off end.

At the bottom end of tracking member (150) is a foldably attached appendage (154) that is notched at its left and right attachment edges to slidably engage in another component of the preferred embodiment. Tracking member (150) is joined to edge panel (146*c*) with a flexible attachment joint (156) that permits folding and a limited amount of pivoting movement of tracking member (150) relative to panel (146*c*). Between the two parallel foldlines (148*a*) that separate cover panel (146*a*) from center panel (146*b*), is a rectangular aperture (158) that is dimensioned to slidably receive the end of foot (152) when foot (152) is folded up to that location during assembly.

Figure 25:
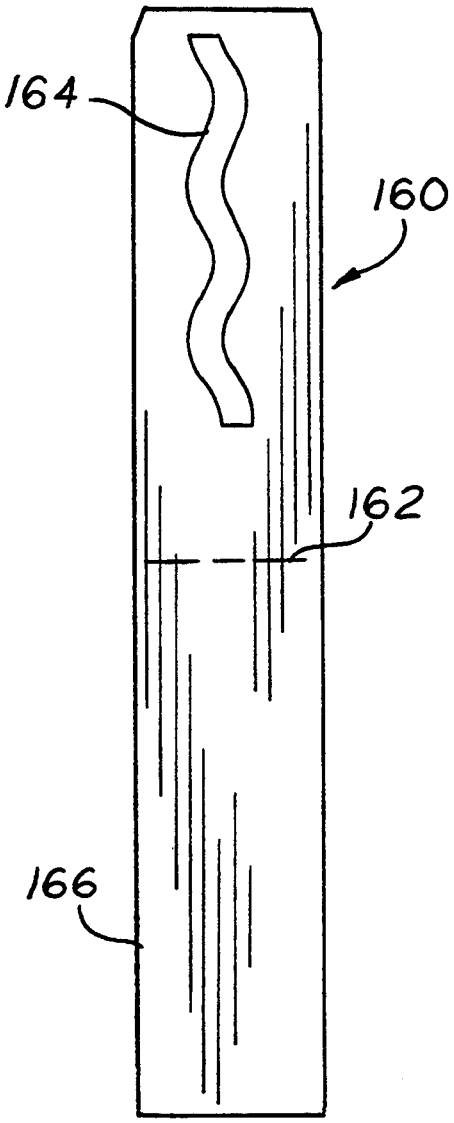
FIG. 25 is a plan view of an unassembled reaction member of the fifth alternate embodiment.

Referring to FIG. 25, the second component of the preferred embodiment is a reaction member (160) that is a long, narrow rectangular shape and is dimensioned in its width to fit between foldlines (148*a*,148*b*, FIG. 24) so that when cover panel (146*a*) and edge panel (146*c*) are folded over center panel (146*b*) with reaction member (160) and tracking member (150) inside, the reaction member will easily slide within guidance structure (144) in a controlled, linear motion. Reaction member (160, FIG. 25) is divided in it's length into two halves by a foldline (162). The upper half holds a track (164) and the lower half functions as a decorative cover (166). Cut through the upper half of reaction member (160) is track (164) that is a balanced, serpentine-shaped aperture that has parallel curving edges and is dimensioned in it's width to slidably receive the notched appendage (154, FIG. 24). The lower half of reaction member (160), cover (166), is folded on top of the upper half in assembly and hides the track (164) from view.

Figure 26:
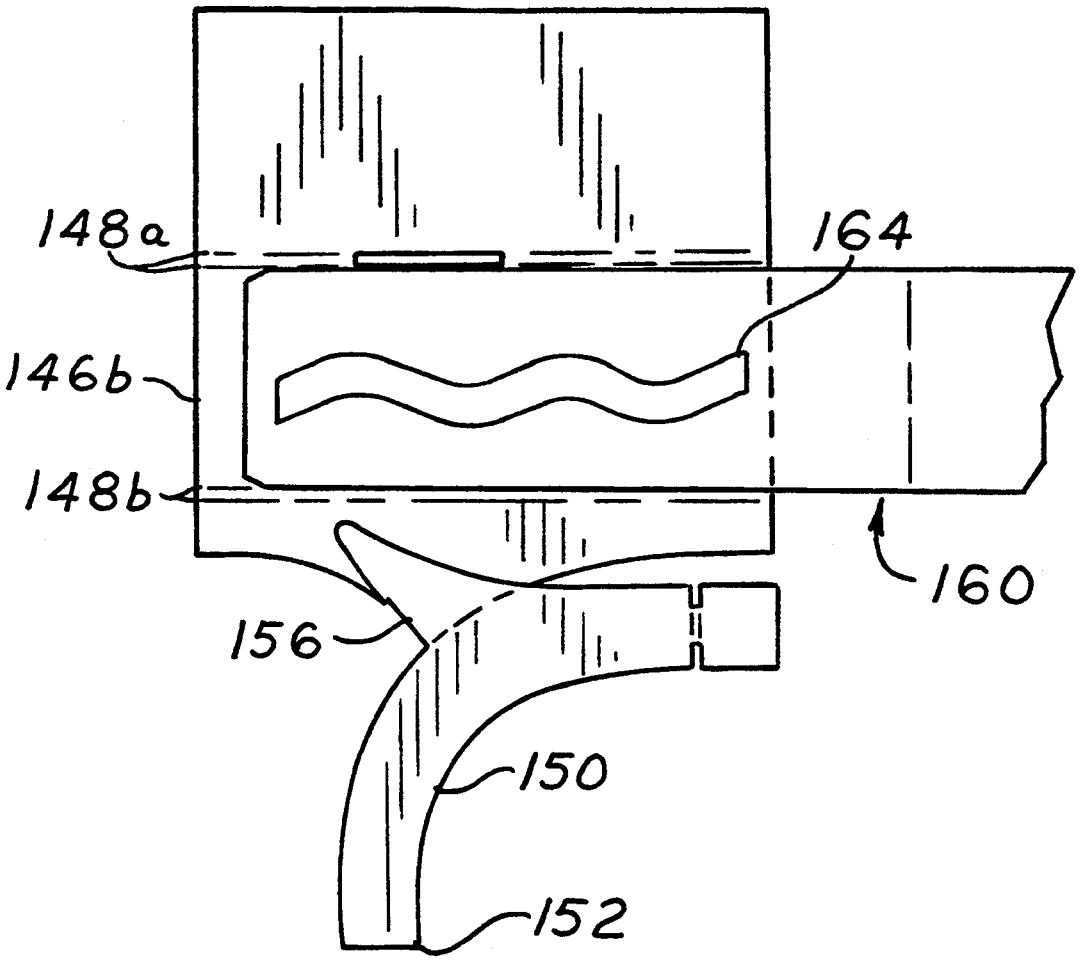
FIG. 26 is a plan view of the partially assembled components of FIGS. 24 and 25.

Referring to FIG. 26, in the process of assembly, tracking member (150) is folded at the flexible attachment joint (156) so that foot (152) is rotated from a laterally-directed position to a downwardly-directed position. Reaction member (160) is then positioned between foldlines (148*a*,148*b*) so that track (164) lays upon the surface of center panel (146*b*).

Figure 27:
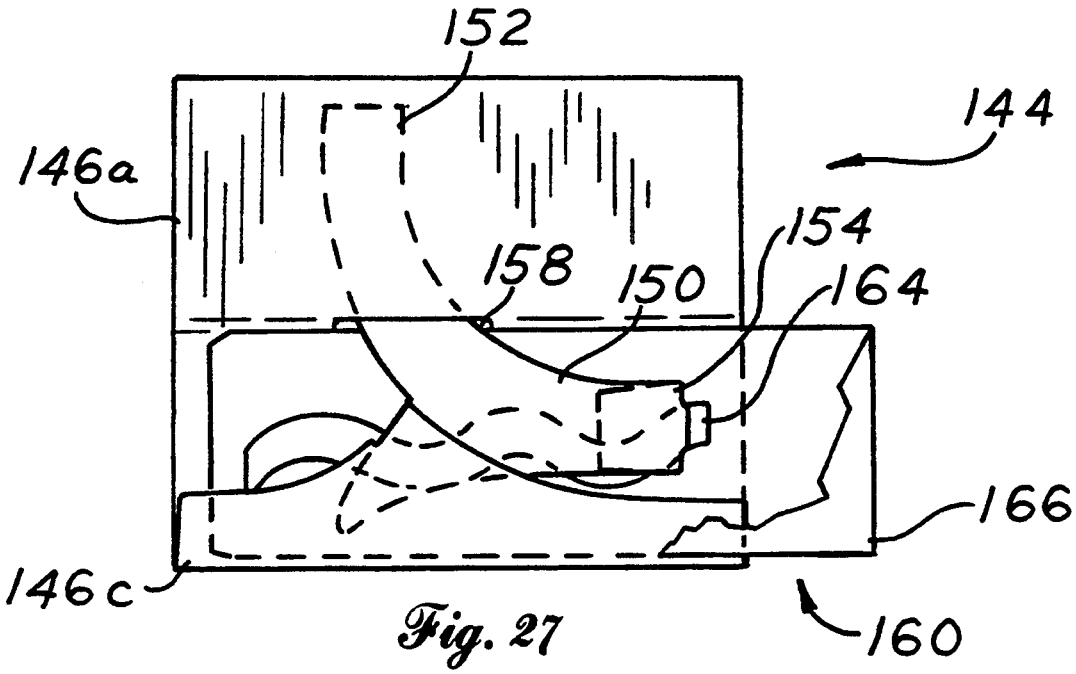
FIG. 27 is a plan view of a more advanced degree of assembly of the components of FIGS. 24 and 25.
Figure 28:
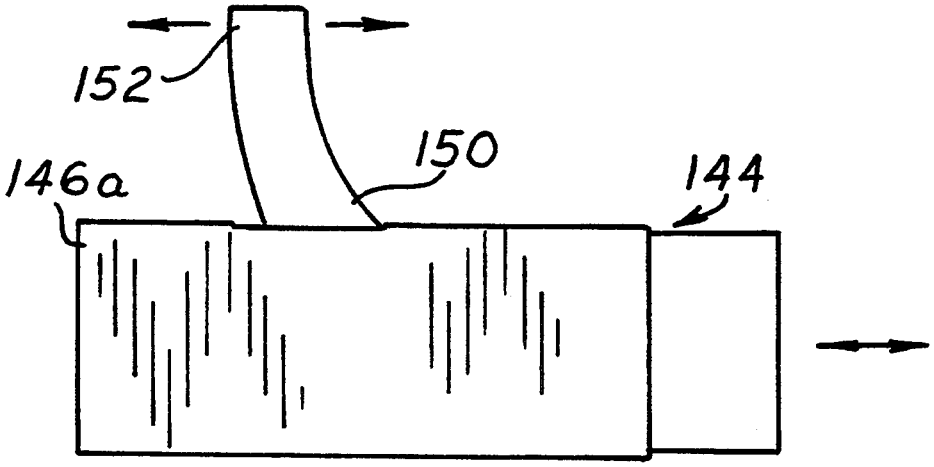
FIG. 28 is a plan view of the assembled components of FIGS. 24 and 25.
Figure 29:
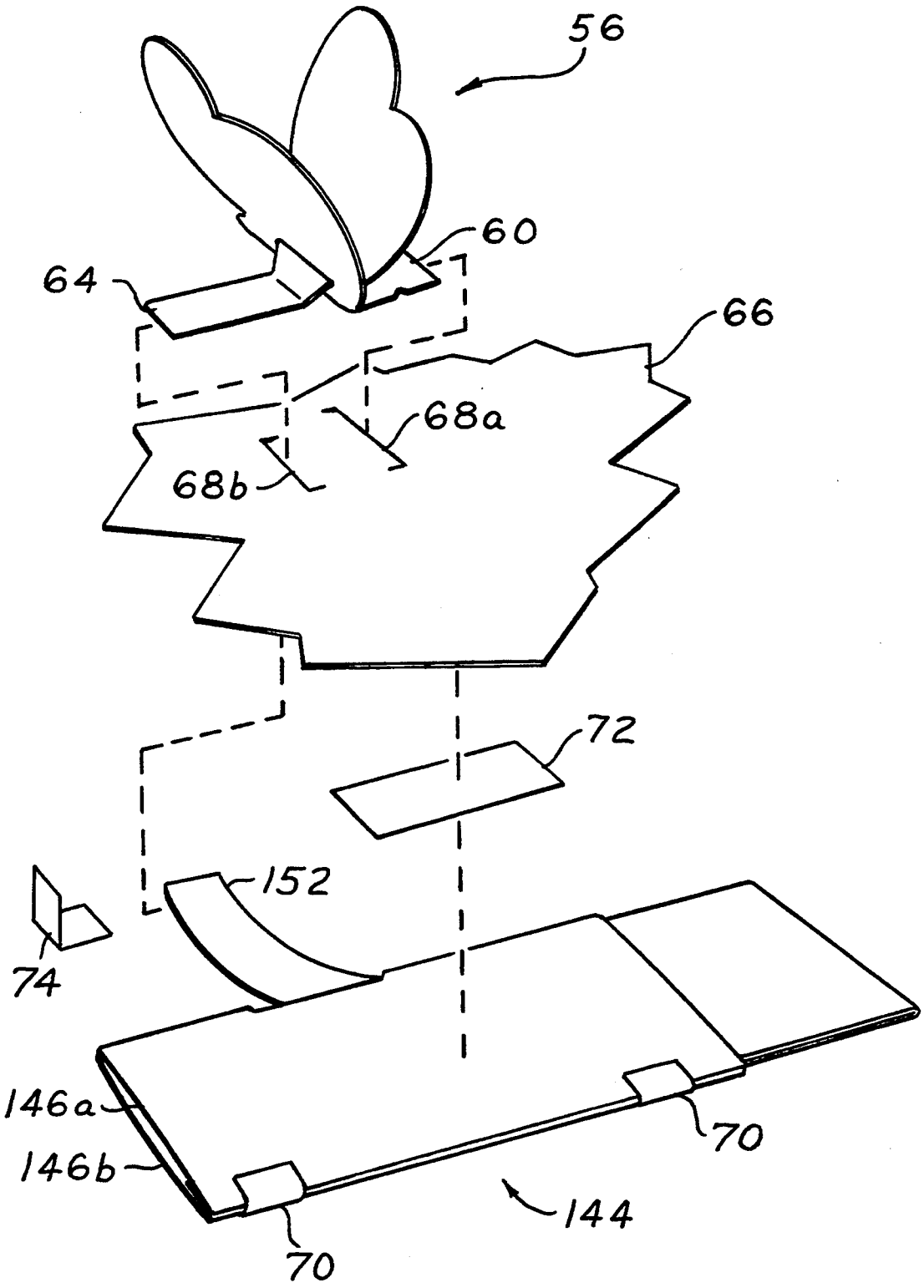
FIG. 29 is a partially exploded view of the fifth alternate embodiment showing the assembly relationship of the components.

Referring to FIG. 27, appendage (154) is folded onto tracking member (150) which itself is folded with edge panel (146*c*) onto reaction member (160). Appendage (154) is fitted through track (164) in reaction member (160). Foot (152) is inserted through a rectangular aperture (158) in guidance structure (144). Referring to FIG. 27 and 28, reciprocating action can be achieved at the foot (152) end of tracking member (150) when the cover (166) is folded on top of the edge panel (146*c*), cover panel (146*a*) is folded over, and reaction member (160) is pushed and pulled through the folded guidance structure (144). Referring to FIG. 29, other elements in this embodiment, graphical structure (56), card (66), and tapes (70,72,74), are the same elements as described in the recitation of the preferred embodiment (FIG. 9) and are used similarly herein.

The relationship of all parts in this embodiment is shown in FIG. 29. The components of this embodiment are assembled into final working relationship with tabs (60, 64) on graphical structure (56) inserted into slots (68a,68b) on the card (66, shown in partial view in FIG. 29), pieces of tape (70) adhered to guidance structure (144) to hold together structure cover panel (146a) and center panel (146b) in a closed position, and double-sided tape (72) adhering guidance structure (144) to card (66) so that inner tab (64) is aligned with foot (152). Foot (152) is connected to graphical-structure inner tab (64) with a piece of tape (74). The assembled device is then operated in a similar way as the device in the preferred embodiment.

7. A final embodiment is now described that combines various features from the previously recited forms in order to indicate how elements of those forms can be modified and combined into a wider variety of products while still adhering to the fundamental concept of the invention.

Figure 30:
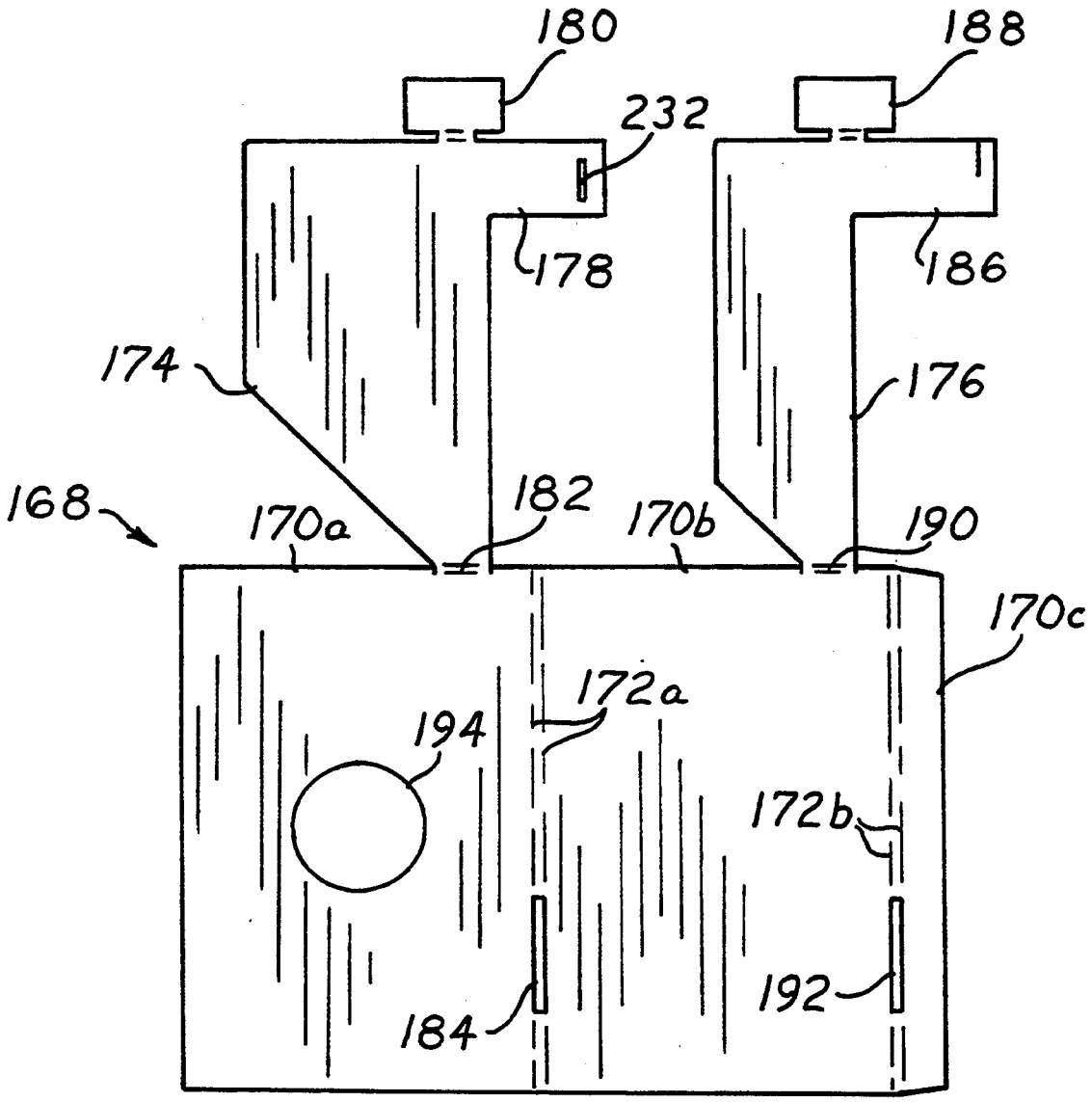
FIG. 30 is a plan view of an unassembled guidance structure of the sixth alternate embodiment.

Referring to a component of the sixth alternate embodiment in FIG. 30, a guidance structure (168) is the main structure of the device. Guidance structure (168) is divided into three panels (170a,170b,170c) by parallel foldlines (172a,172b) and also has a left tracking member (174) and a right tracking member (176) attached to it. Cover panel (170a) is rectangularly shaped and has a right edge of two parallel foldlines (172a) that mark it's attachment to center panel (170b). Center panel (170b) has substantially the same dimensions as cover panel (170a) and center panel (170b) has as it's right edge two parallel foldlines (172b) that mark it's attachment to edge panel (170c). Edge panel (170c) is the same length as center panel (170b) but is dimensionally less than half of its width.

Joined to cover panel (170a) at its top edge and extending upwardly therefrom, in the unassembled form, is a left tracking member (174). Left tracking member (174) is a flat, inverted boot-shaped attachment with a leg portion that is approximately two-thirds the width of cover panel (170a); the overall length of tracking member (174) is approximately the same as cover panel (170a). The foot (178) of this boot shape extends to the right from the center of tracking member (174) and terminates in a squared-off end.

At the top end of tracking member (174) is a foldably attached appendage (180) that is notched at its left and right attachment edges to slidably engage in another component of this embodiment. Tracking member (174) is joined to cover panel (170a) with a flexible attachment joint (182) that permits folding and a limited amount of pivoting movement. Between the two parallel foldlines (172a) that separate cover panel (170a) from center panel (170b), is a rectangular aperture (184) that is dimensioned to slidably receive the end of foot (178) when foot (178) is folded down to that location during assembly.

A near duplicate tracking member is attached to center panel (170b). Joined to center panel (170b) at its top edge and extending upwardly therefrom is a tracking member (176). Right tracking member (176) is a flat, inverted boot-shaped attachment with a leg portion that is approximately one-half the width of center panel (170b); the overall length of tracking member (176) is the same as left tracking member (174). The foot (186) of this boot shape extends to the right from the center of tracking member (176) and terminates in a squared-off end. At the top end of tracking member (176) is a foldably attached appendage (188) that is notched at its left and right attachment edges to slidably engage in another component of this embodiment. Tracking member (176) is joined to center panel (170b) with a flexible attachment joint (190) that permits folding and a limited amount of pivoting movement. Between the two parallel foldlines (172b) that separate center panel (170b) from edge panel (170c), is a rectangular aperture (192) that is dimensioned to slidably receive the end of foot (186) when foot (186) is folded down to that location during assembly. Referring back to cover panel (170a), the panel also has a circular aperture (194) that is centered in the panel and is about one-third the width of cover panel (170a) in its diameter.

Figure 31:
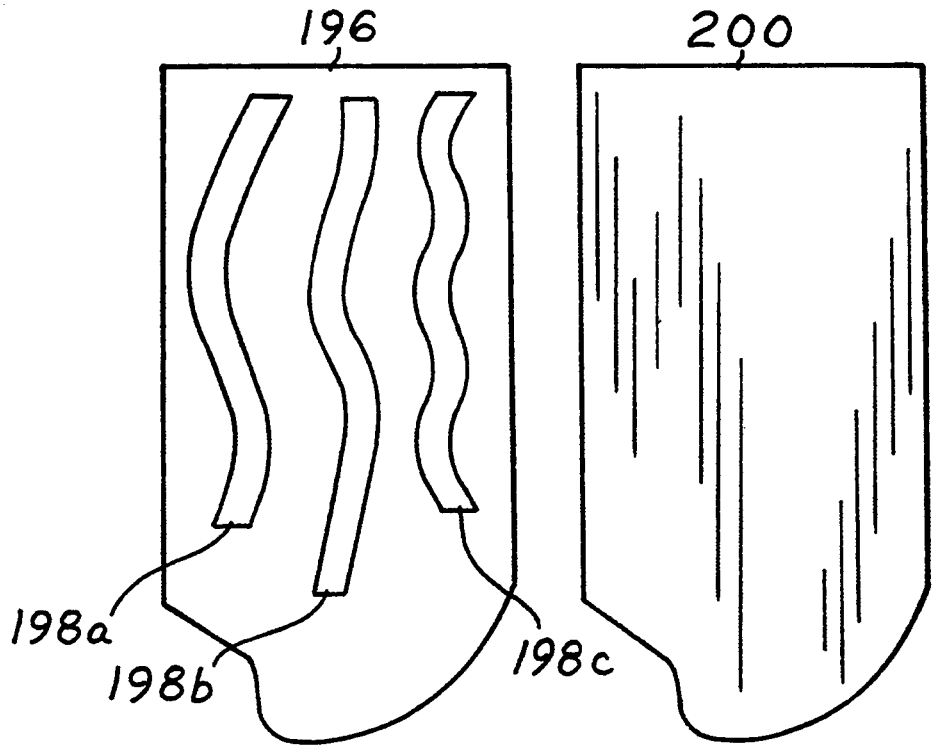
FIG. 31 is a plan view of an unassembled reaction member and cover of the sixth alternate embodiment.

Referring to FIG. 31, the second component of the sixth alternate embodiment is a reaction member (196) that is rectangular with a fin-shaped bottom edge and is dimensioned in its width to fit between fold lines (172a,172b, FIG. 30) so that when cover panel (170a) and edge panel (170c) are folded over center panel (170b) with reaction member (196), and tracking members (174,176) inside, the reaction member will easily slide within guidance structure (168) in a controlled, linear motion. Cut through the center area of reaction member (196, FIG. 31) are three tracks (198a,198b,198c) that are generally serpentine-shaped apertures that have parallel curving edges and are dimensioned in their widths to slidably receive the notched appendages (180,188,206). A cover (200) that is the same shape as reaction member (196) is glued to reaction member (196) at its bottom edge and hides tracks (198a,198b,198c) from view.

Figure 32:
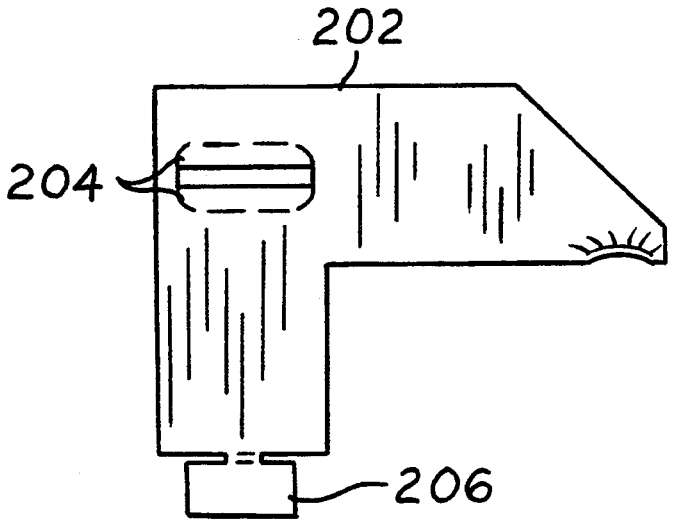
FIG. 32 is a plan view of an unassembled tracking member of the sixth alternate embodiment.

Referring to FIG. 32, another component of this embodiment is a rotatable tracking member (202). This is basically an L-shaped shaped piece turned 90 degrees clockwise that has a rotating-attachment configuration where the horizontal and vertical parts join. The attachment configuration is formed from two parallel flaps (204) that are narrow strips foldably attached by their long edges to opposite sides of an aperture and are notched inwardly at their foldlines in a way that makes tab-like ends on the flaps. The dimensions of the flaps are such that their tab-like ends will fold into, and the bases of the notches will engage with, aperture (194, FIG. 30) at four points. At the lower end of the tracking member's vertical part is a foldably attached appendage (206, FIG. 32) that is notched at its left and right attachment edges to slidably engage in track (198b) of reaction member (196, FIG. 31). At the end of the tracking member's horizontal part (FIG. 32) a graphical image of an eyelid is imprinted.

Figure 33:
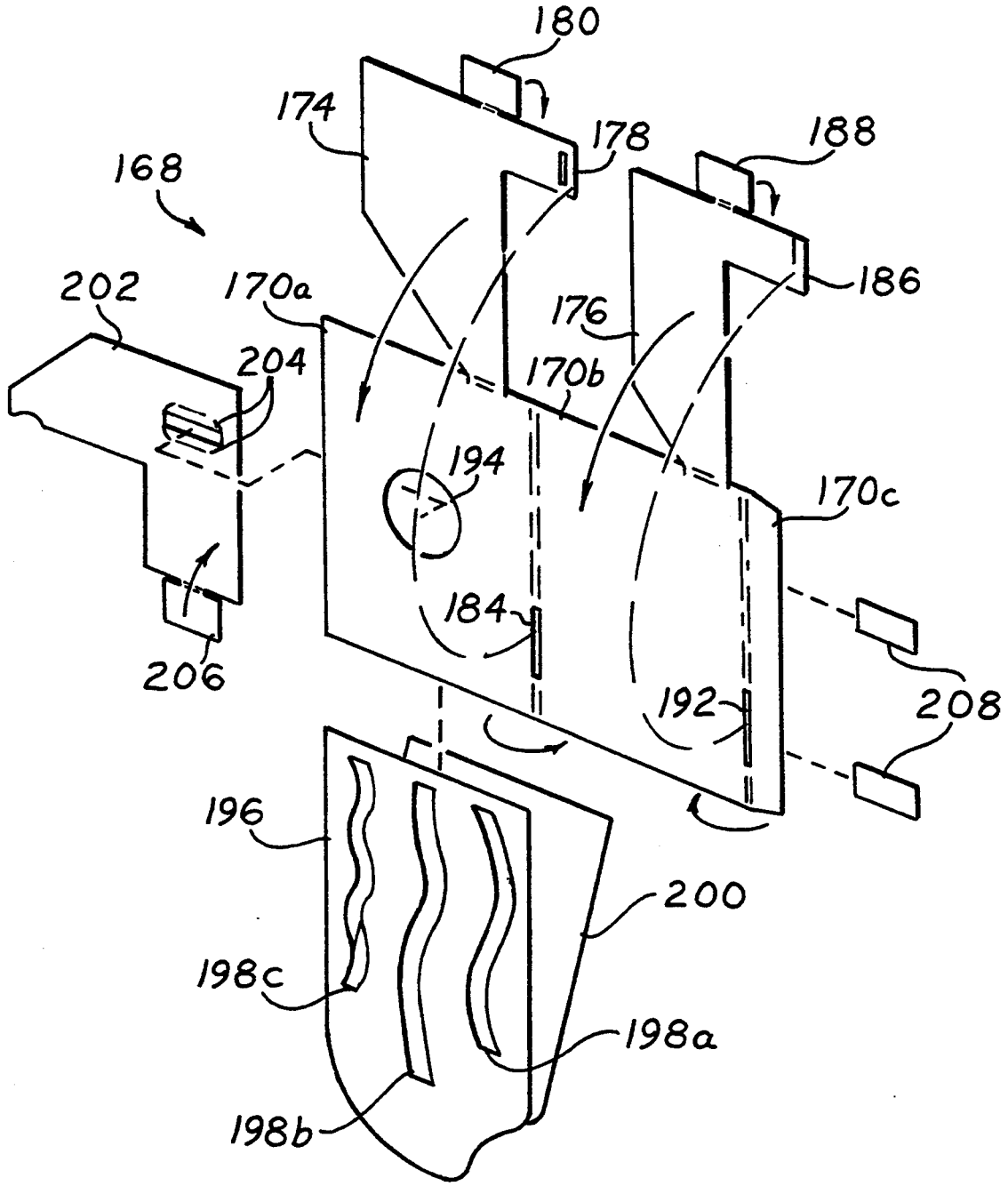
FIG. 33 is an exploded view of assembly relationships of components in FIGS. 30, 31, and 32.
Figure 34:
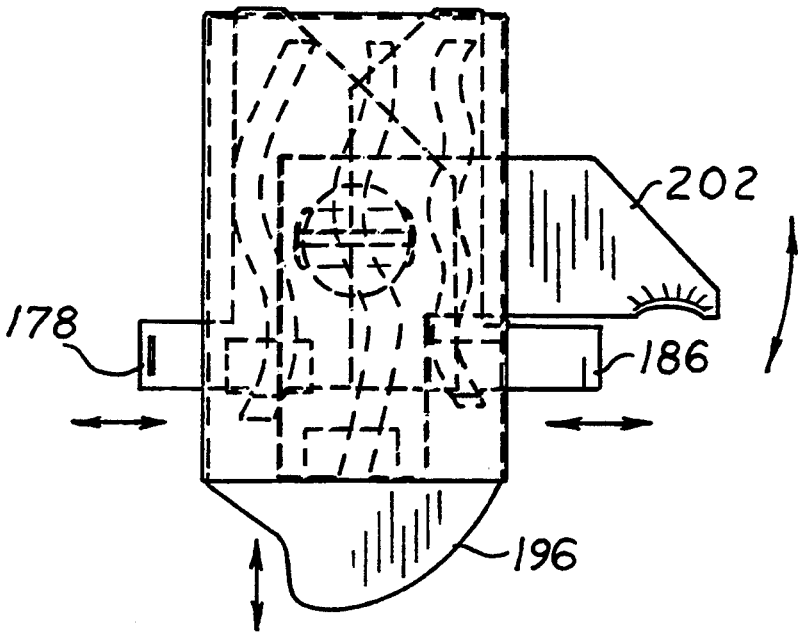
FIG. 34 is a plan view of the assembled components of FIGS. 30, 31, and 32 shown in a transparent assembly.

Referring to FIG. 33, in the process of assembly, flaps (204) on rotatable tracking member (202) are aligned with the back side of aperture (194) and are poked through so they engage in the aperture. Appendages (180, 188) are then back-folded onto tracking members (174,176) respectively. Tracking members (174,176) are folded onto cover panel (170a) and center panel (170b) followed by foot (178) being inserted into aperture (184) and foot (186) being inserted into aperture (192). Reaction member (196) is then turned over and slid over the folded tracking member (174) with reaction member's attached cover (200) slid to the other side of cover panel (170a) and over the attached rotatable tracking member (202). Then appendage (180) is worked up through left track (198a) and folded up. Center panel (170b) with tracking member (176) folded into it is then folded onto cover panel (170a). With the panels slightly apart, appendage (188) is worked through right track (198c) and folded up. Edge panel (170c) is then folded and tucked in between cover panel (170a) and reaction member (196). At this point the guidance structure (168) is sealed closed with tapes (208). The last step in this part of the assembly is to pull reaction member (196) down until middle track (198*b*) is exposed. Appendage (206) is then poked through middle track (198*b*) and folded upwards and tucked under center panel (170*b*). Referring to FIG. 34 (which is a transparent stackup showing assembly relationships), reciprocating action can now be achieved at foot (178), foot (186), and at the horizontal end of tracking member (202) by pulling and pushing reaction member (196).

Figure 35:
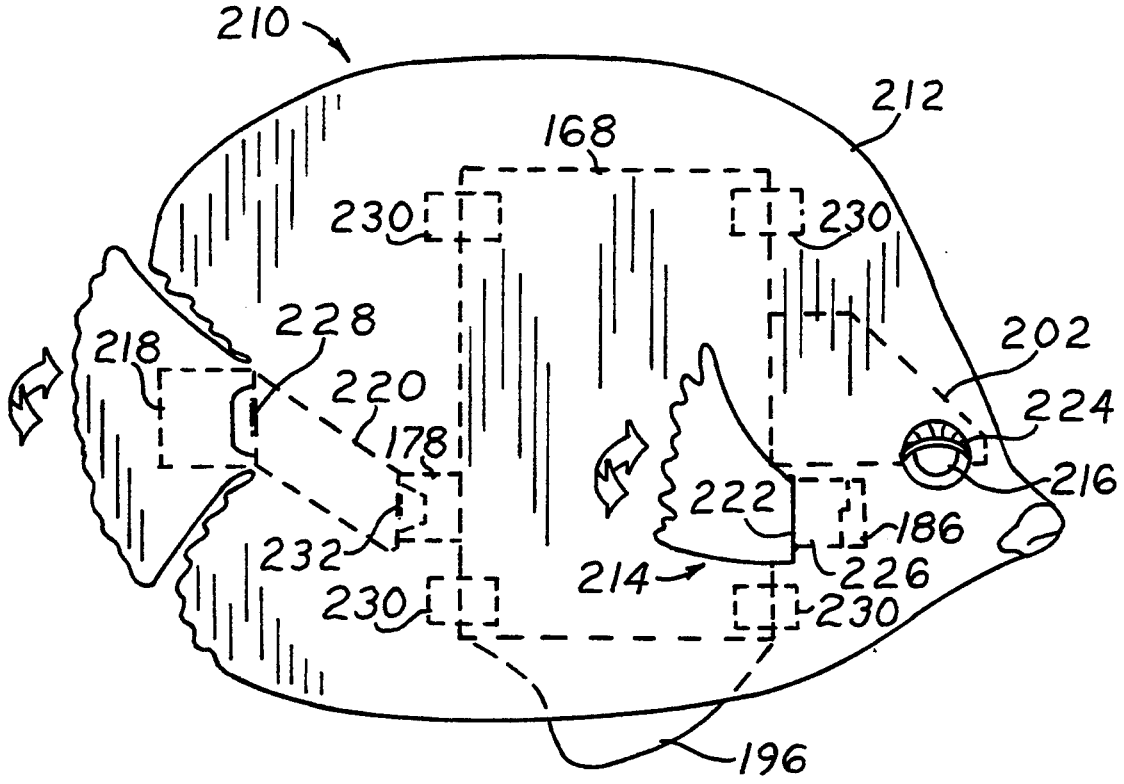
FIG. 35 is a plan view of the assembled graphical structure.
Figure 36:
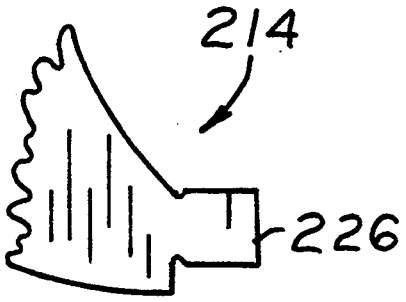
FIG. 36 is a plan view of a fin component.
Figure 37:
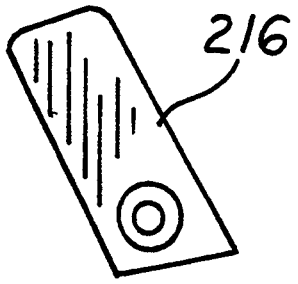
FIG. 37 is a plan view of an eye component.

Referring to FIG. 35, a graphical structure (210) in this embodiment is in the form of a fish and consists of a body (212), a fin (214), an eye (216), an actuation plate (218), and a linkage (220). Body (212) is shaped like a tropical fish and has a foldline at the attachment edge of its tail. Body (212) also has a vertical slot-shaped aperture (222) where fin (214) is inserted and a round aperture (224) where the eye would be located. Referring to FIG. 36, fin (214) is shaped exactly like a fishes side fin but also has a tab-like plane (226) extending from the inner-fin edge and ending in a squared-off shape. The inner-fin edge is where the fin intersects with the body (212). There are two symmetrically-located notches on the upper and lower edges of plane (226) which is dimensioned in its width to lock into aperture (222, FIG. 35). Now referring to FIG. 37, eye (216) is a narrow strip on which a fish-eye image is imprinted near the center of the strip . One end of the strip is glued below aperture (224, FIG. 35) on the obverse side of body (212) so the eye shows through the aperture. The top end of the strip is unattached.

Figure 38:
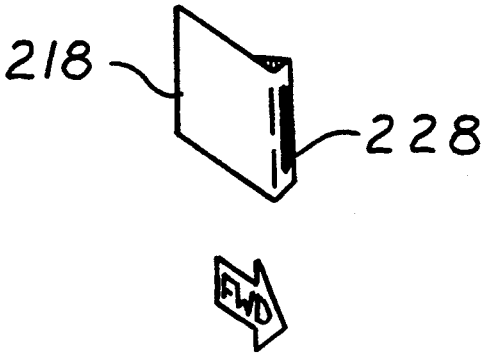
FIG. 38 is a three-dimensional view of an actuation plate component.
Figure 39:
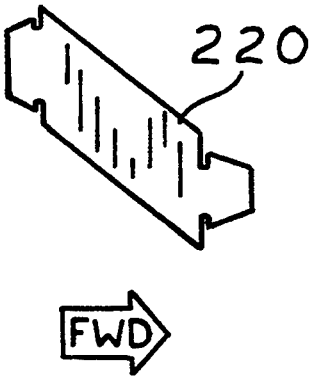
FIG. 39 is a plan view of a linkage component.

Another part, actuation plate (218, FIG. 38), is a small rectangularly-shaped piece with a right-angled lip that stands up from the plane of plate (218) on the plane's narrower edge; the lip has a slot-shaped aperture (228) parallel to its edge. Plate (218) is attached with glue to the tail on the obverse side of body (212, FIG. 35) so the lip is aligned with the tail's foldline. Referring to FIG. 39, linkage (220) is a narrow strip with inwardly-notched tabs at either end that is dimensioned to movably connect actuation plate (218, FIG. 35) to foot (178) in the last phase of assembly. Graphical structure (210) is assembled by plane (226) on fin (214) being inserted into aperture (222) and pulled through until the notches engage the edges of aperture (222).

In the final phase of assembly, guidance structure (168), which was previously assembled in this description, is attached to the obverse side of body (212) with four tapes (230) so that the end of foot (186) aligns with the end of plane (226). During attachment, the image of the eye lid on tracking member (202) is slid under eye (216) so that it appears through aperture (224). Foot (186) and plane (226) both have vertical notches that engage one another and create an interlocking, hinged connection. Finally, one end of linkage (220) is inserted into aperture (228) and the other end into an aperture (232) on foot (178).

The assembled device is operated by holding graphical structure (210) in a fixed position and pulling and pushing reaction member (196) in a linear motion. The reciprocating members cause the fishes fins to move back and forth and the eye to open and close.

CONSTRUCTION DETAILS

To assist an individual skilled in the art of paper constructions, some details of manufacture are offered: a light card stock about the weight and flexibility of manila file folders is similar to the preferred manufacturing material. All cuts of edges where moving parts contact must be smooth and without burrs. Alternating angles of the track paths should be obtuse (greater than 90 degrees) from one turn to the next with angles taken from a line perpendicular to the lengthwise centerline of the reaction member to be greater than 45 degrees. Tape used for attachments can be any flexible tape. Materials should be prefolded at all foldlines prior to assembly to facilitate construction.

SCOPE

The foregoing description of the preferred embodiment and alternate embodiments of the invention has been presented for the purposes of illustration and description. It is not intended to be exhaustive or to limit the invention to the precise forms disclosed. Many modifications and variations are possible in light of the above teaching. Types of variations that are possible within the scope of the invention are briefly described as follows:

a. The graphical structures described herein are representations of a butterfly and a fish. However, numerous other forms of graphical novelties may be substituted using simple mechanisms common in the field of paper engineering which are of generally obvious designs or which become obvious by the teaching disclosed in the document.

b. Wide variations in the path direction of the reaction member are possible. These variations are significant as the changes of path directions determines the choreography of the graphical structure movement which may be uniquely matched to the specific graphical structure attached.

c. Two or more of the embodiments described herein, or variations of them, may be combined into a single, more complex embodiment while still following the teaching of this invention.

d. Any number of different adhesive materials and methods may be used to construct these devices.

Therefore, it is intended that the scope of the invention be limited not by the previous description, but rather by the claims appended hereto.

What is claimed is:

1. A device for animating graphical structures comprising:

a guidance structure that provides constant directional retention for a reaction member, a reaction member slidably connected to said guidance structure and having a track, said track defining a substantially zig-zag path, a tracking member that is movably connected to said guidance structure and that slidably fits into said track of said reaction member and movably responds to changes in direction of the track, and a movable graphical structure that is flexibly connected to said tracking member and connected to said guidance structure.

2. The device as defined in claim 1, wherein said guidance structure is formed from a blank of flexible material that is foldable into a plurality of panels;

also wherein said tracking member is pivotally attached to said guidance structure and wherein said reaction member is installed within the folded panels of said guidance structure so as to permit constant-directional movement of the reaction member relative to said guidance structure.

3. The device as defined in claim 2, wherein said tracking member is foldably attached to said guidance structure by a flexible attachment joint that permits pivoting movement.

4. The device as defined in claim 2, wherein said tracking member is attached to said guidance structure by a rotatable joint that permits pivoting movement.

5. The device as defined in claim 4, wherein said rotatable joint comprises a plurality of foldably attached flaps on said tracking member that foldably engage the edge of a hole cut into said guidance structure wherein said flaps are arranged on the basis of a circle and provide rotatable retention for said tracking member relative to said guidance structure.

6. The device as defined in claim 1, further comprising a card structure that attaches to said guidance structure to provide a visually pleasing cover, wherein said card structure is an intermediary plane for connection between said guidance structure and said graphical structure.

7. The device as defined in claim 1, wherein all the assembled components assume a thin and flattened profile at a minimum of one point in the operation of said device.

8. A device for converting constant-directional motion into alternating motion for the animation of graphical structures comprising:

a guidance structure that restrictively controls the motion of a reaction member, a reaction member movably interconnected to said guidance structure to follow a path of relatively constant direction, a track in said reaction member that follows an undulating path and wherein said track is capable of controlling direction of movement of a tracking member engaging said track, and a tracking member rotatably connected with said guidance structure and having an appendage that engages said track.

9. The device as defined in claim 8, wherein said reaction member has a cover attached to it.

10. The device as defined in claim 8, further comprising a movable graphical structure that is movably connected to said tracking member wherein said graphical structure is also connected to said guidance structure.

11. The device as defined in claim 8, further comprising a card structure that attaches to said guidance structure and also comprising a movable graphical structure that is connected to said tracking member wherein said graphical structure is also connected to said card structure.

12. In combination:

a guidance structure that provides constant directional retention for a minimum of one slidably-connected reaction member, a reaction member having at least one track that has substantially parallel sides and wherein said track follows a path that has at least one obtuse angle, at least one tracking member movably connected to said guidance structure and having an appendage that slidably fits into said track of said reaction member and movably responds to pushing by said sides of said track in said reaction member, and a minimum of one movable graphical structure that is flexibly connected to said tracking member and is also connected to said guidance structure.

13. The combination as defined in claim 12, further comprising a decorative card that is attached to and between said guidance structure and said graphical structure.

* * * * *